US011713183B2

(12) United States Patent
Polloni et al.

(10) Patent No.: US 11,713,183 B2
(45) Date of Patent: Aug. 1, 2023

(54) RIGID PACK FOR SMOKING ARTICLES WITH A HINGED OR SLIDING LID

(71) Applicant: G.D SOCIETA' PER AZIONI, Bologna (IT)

(72) Inventors: Roberto Polloni, Bologna (IT); Giuseppe Marchitto, Bologna (IT); Luca Federici, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 78 days.

(21) Appl. No.: 17/415,639

(22) PCT Filed: Dec. 4, 2019

(86) PCT No.: PCT/IB2019/060436

§ 371 (c)(1),
(2) Date: Jun. 17, 2021

(87) PCT Pub. No.: WO2020/128700

PCT Pub. Date: Jun. 25, 2020

(65) Prior Publication Data

US 2022/0055822 A1 Feb. 24, 2022

(30) Foreign Application Priority Data

Dec. 20, 2018 (IT) ..... 102018000020494

(51) Int. Cl.
*B65D 85/10* (2006.01)

(52) U.S. Cl.
CPC ... *B65D 85/1054* (2013.01); *B65D 85/10564* (2020.05)

(58) Field of Classification Search
CPC ..... B65D 85/1054; B65D 85/10564; B65D 85/1036; B65D 85/10565
(Continued)

(56) References Cited

U.S. PATENT DOCUMENTS 4,646,960 A * 3/1987 Challand ..... B65D 85/1054 206/273
6,230,893 B1 * 5/2001 Karow ..... B65D 83/0463 229/125.125
(Continued)

FOREIGN PATENT DOCUMENTS

EP 1466844 A1 10/2004
EP 1884467 A1 2/2008
(Continued)

OTHER PUBLICATIONS

International Search Report and Written Opinion, corresponding International application No. PCT/IB2019/060436 dated Mar. 2, 2020.

*Primary Examiner* — Chun Hoi Cheung
(74) *Attorney, Agent, or Firm* — Marshall, Gerstein & Borun LLP

(57) ABSTRACT

A pack for smoking articles having; a container; an inner wrap, which encloses a group of smoking articles and is housed in the container; a hinged lid, movable between a closed position and an open position, a collar, which embraces the inner wrap and is glued on the inside of the container so as to partially project out of the open top end and engage a corresponding inner surface of the lid, when the lid is arranged in a closed position; a slider, which is firmly connected to the lid and is coupled to the container in a sliding manner so as to slide relative to the container along a sliding direction; a locking system, which is interposed between the container and the slider and, in the closed position of the lid, prevents the slider from sliding relative to the container. The hindering of the sliding of the slider relative to the container, determined by the locking system,
(Continued)

can be deactivated by an external action by the user to elastically deform at least part of at least one wall of the container.

14 Claims, 18 Drawing Sheets

(58) Field of Classification Search
USPC ..... 206/528, 561, 538, 242–276, 1.5; 229/125.125
See application file for complete search history.

(56) References Cited

U.S. PATENT DOCUMENTS 6,491,211 B1 * 12/2002 Evans ..... B65D 77/02 206/532
7,389,875 B2 * 6/2008 Sandberg ..... B65D 5/38 229/125.125
7,819,250 B2 * 10/2010 Sattel ..... B65D 83/0463 229/125.125
7,845,496 B2 * 12/2010 Hession ..... B65D 83/0463 229/125.125
8,011,512 B2 * 9/2011 Brollier ..... B65D 83/0463 206/532
8,464,867 B2 * 6/2013 Holloway ..... B65D 85/1009 206/268
8,474,624 B2 * 7/2013 Cronin ..... B65D 50/046 220/281
8,757,371 B2 * 6/2014 Draghetti ..... B65D 85/10564 206/268
8,997,979 B2 * 4/2015 Ghini ..... B65D 5/38 206/267
9,198,465 B2 * 12/2015 Ghini ..... B65D 5/728
10,017,291 B2 * 7/2018 Smith ..... B65D 5/728
10,730,671 B2 * 8/2020 Drosos ..... B65D 50/066
10,759,580 B2 * 9/2020 Davis ..... B65D 5/38
10,947,031 B2 * 3/2021 Polloni ..... B65D 85/1027
11,059,662 B2 * 7/2021 Marchitto ..... B65D 85/1009
11,148,874 B2 * 10/2021 Polloni ..... B65D 85/1081
2002/0189969 A1 * 12/2002 Renck ..... B65D 81/054 206/453
2008/0047226 A1 * 2/2008 Corsini ..... B65B 19/20 53/234

FOREIGN PATENT DOCUMENTS

WO WO-2010/058237 A1 5/2010
WO WO-2016/132312 A1 8/2016
WO WO-2017/002066 A1 1/2017

* cited by examiner

RIGID PACK FOR SMOKING ARTICLES WITH A HINGED OR SLIDING LID

CROSS-REFERENCE TO RELATED APPLICATIONS

This patent application is a U.S. national phase of International Patent Application No. PCT/IB2019/060436 filed Dec. 4, 2019, which claims the benefit of priority from Italian patent application no. 102018000020494 filed on Dec. 20, 2018, the respective disclosures of which are each incorporated herein by reference in their entireties.

TECHNICAL SPHERE

The present invention relates to a rigid pack for smoking articles with a hinged or sliding lid.

The present invention finds advantageous application to a pack of cigarettes, which the description below will make explicit reference to without detracting from its general application.

PRIOR ART

Rigid cigarette packs with a hinged lid are the most popular cigarette packs currently on the market because they are easy to make, easy and practical to use, and offer good protection to the cigarettes inside them.

A rigid cigarette pack with a hinged lid comprises a group of cigarettes wrapped in a sheet of metallized paper wrapping to define an inner wrap and a rigid container housing the inner wrap; the container is cup-shaped, has an open top end, and has a lid, which is also cup-shaped and is hinged to the container along a hinge to rotate, with respect to said container, between an open and a closed position of the open end. A collar which is folded and connected to the inside of the container so as to partially project out of the open end and engage a corresponding inner surface of the lid, when said lid is arranged in a closed position.

Recently, a new type of rigid cigarette pack described for example in the patent application EP1466844A1 or patent application EP1884467A1 has been proposed wherein the lid performs a roto-translation (i.e. both a translation and a rotation) to move from the closed to the open position and vice versa. The opening of such a rigid cigarette pack is simple and intuitive even for a child and therefore such a rigid cigarette pack cannot be classified as "child-proof" or "child resistant", namely suitable to prevent a child from opening it. Normally, a cigarette pack is classified as "child-proof" if its opening, i.e. the ability to access the contents, is precluded by mechanisms that an uneducated user would not be able to release. In other words, a cigarette pack is defined as "childproof" when its opening (and thus access to its contents) is not obvious and requires the application of particular forces or torques at predetermined points, or sequences of movements that are not intuitive for the effective release of the cigarette pack opening.

Patent application WO2016132312A1 describes a cigarette pack comprising: an inner container that houses a group of smoking articles; an outer container that houses the inner container so as to slide and allow the inner container to slide between a closed configuration and an open configuration in which the inner container is partially extracted from the outer container; and a locking system that comprises a locking element and an engagement portion and locks, in a manner that can be deactivated by an external action of a user, the sliding of the inner container with respect to the outer container when the inner container is both in the closed configuration and in the open configuration. In particular, the locking system can be deactivated by the user by exerting a sufficiently strong thrust on the inner container compared to the outer container (i.e. by pulling/pushing the inner container with sufficient force) until an elastic deformation of the locking flaps which are part of a stiffening panel on the rear wall of the outer container is achieved.

DESCRIPTION OF THE INVENTION

The purpose of the present invention is to provide a rigid pack of smoking articles with a hinged, sliding lid that can be classified as "child-proof", i.e. that can prevent opening by children, and at the same time is easy and economical to manufacture.

According to the present invention, a rigid pack of smoking articles with a hinged, sliding lid, as claimed in the attached claims, is provided.

The claims describe preferred variants of the present invention, forming an integral portion of the present description.

BRIEF DESCRIPTION OF THE DRAWINGS

The present invention will now be described with reference to the appended drawings, which illustrate some, non-limiting embodiments, wherein.

PREFERRED EMBODIMENTS OF THE INVENTION

Figure 2:
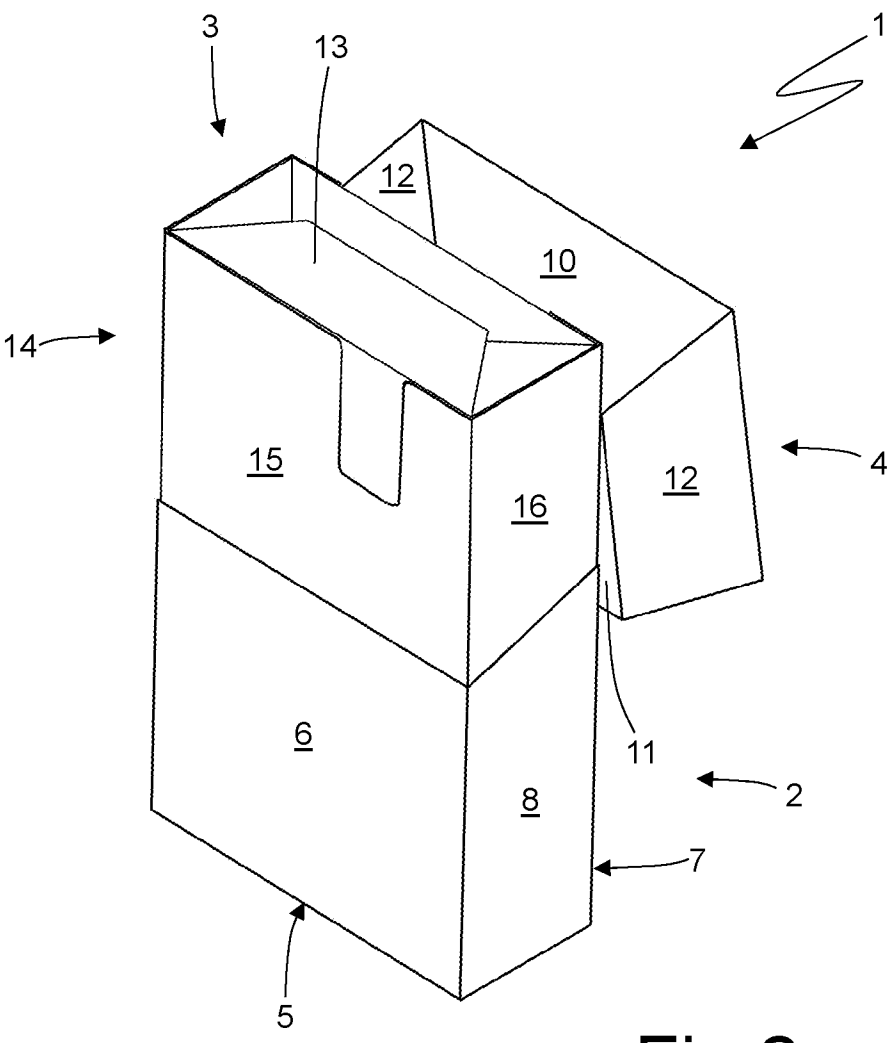
FIG. 2 is a front perspective view of the cigarette pack in FIG. 1 in an exploded configuration.
Figure 1:
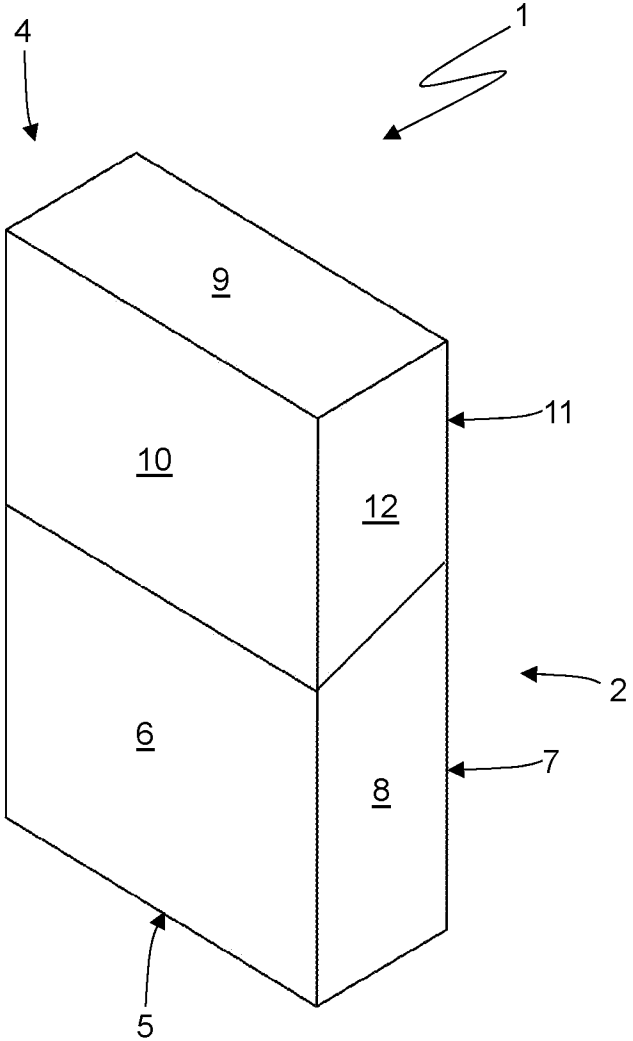
FIG. 1 is a front perspective view and in a closed configuration of a cigarette pack made according to the present invention.
Figures 3, 4, 5:
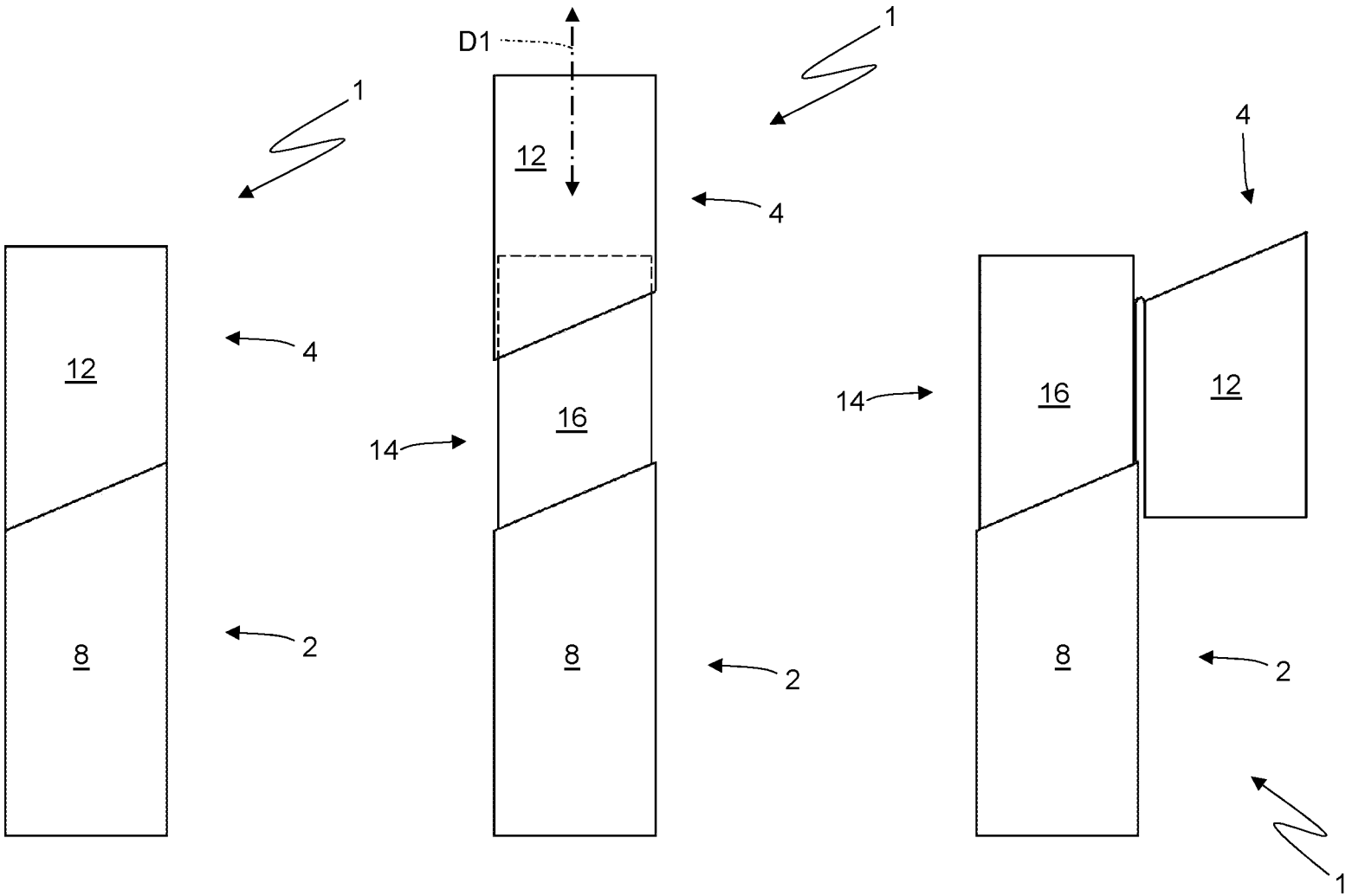
FIGS. 3, 4 and 5 are three side views of the cigarette pack in FIG. 1 during opening of a lid.

In FIGS. 1, 2 and 3 reference numeral 1 globally denotes a rigid cigarette pack. The cigarette pack 1 comprises a container 2 made of cardboard or rigid paper and shaped like a cup. The container 2 has an open upper end 3 (shown in FIG. 2) and is fitted with a lid 4, which is shaped like a cup and is connected to the container 2 to move by roto-translation with respect to the container 2 between a closed position (shown in FIG. 1) wherein the upper end 3 is covered and therefore inaccessible from the outside and an open position (shown in FIG. 2) wherein the open upper end 3 is free and therefore accessible from the outside. The container 2 is substantially a rectangular parallelepiped shape directed in a main vertical direction of extension and cup-shaped and has: an open top end 3, a bottom wall 5 opposite the open top end 3, a front wall 6 and a rear wall 7, parallel to and opposite one another, and two side walls 8, which are parallel and opposite one another. Between the front 6, rear 7 and side 8 walls of the container 2, four longitudinal edges are defined, while between the walls 6, 7 and 8 and the bottom wall 5 of the container 2, four transverse edges are defined.

The lid 4 (which is part of the container 2) has a substantially rectangular parallelepiped shape, is shaped like a cup, and has an open lower end (facing the upper open end 3 of the container 2 when the lid 4 is in the closed position), an upper wall 9 (which is parallel and opposite the bottom wall 5 of the container 2 when the lid 4 is in the closed position), a front wall 10 (which is parallel and aligned with the front wall 6 of the container 2 when the lid 4 is in the closed position), a rear wall 11 (which is parallel and aligned with the rear wall 7 of the container 2 when the lid 4 is in the closed position), and two side walls 12 parallel and opposite to each other (which are parallel and aligned, in particular coplanar and adjacent, to the side walls 8 of the container 2 when the lid 4 is in the closed position). Between the front 10, rear 11 and side 12 walls of the lid 4, four longitudinal edges are defined, while between the walls 10, 11 and 12 and the top 9 wall of the lid 4 four transverse edges are defined. The longitudinal and transverse edges of the lid 4 are parallel and aligned with the corresponding longitudinal and transverse edges of the container 2 when the lid 4 is in the closed position.

As shown in FIG. 2, the cigarette pack 1 comprises an inner wrap 13 which is housed inside the container 2 and contains a group of parallelepiped-shaped cigarettes (not shown). According to the embodiment shown in FIG. 2, the inner wrap 13 is not sealed, consists of a sheet of metallic paper (the so-called "tinfoil") folded around the group of cigarettes and without glue, and has an upper portion that can be removed by tearing (called "pull"), which is removed the first time the cigarette pack 1 is opened; according to a different embodiment not shown, the inner wrap 13 is sealed and has a front and top opening for the extraction of cigarettes closed by a reusable closed label.

Figure 6:
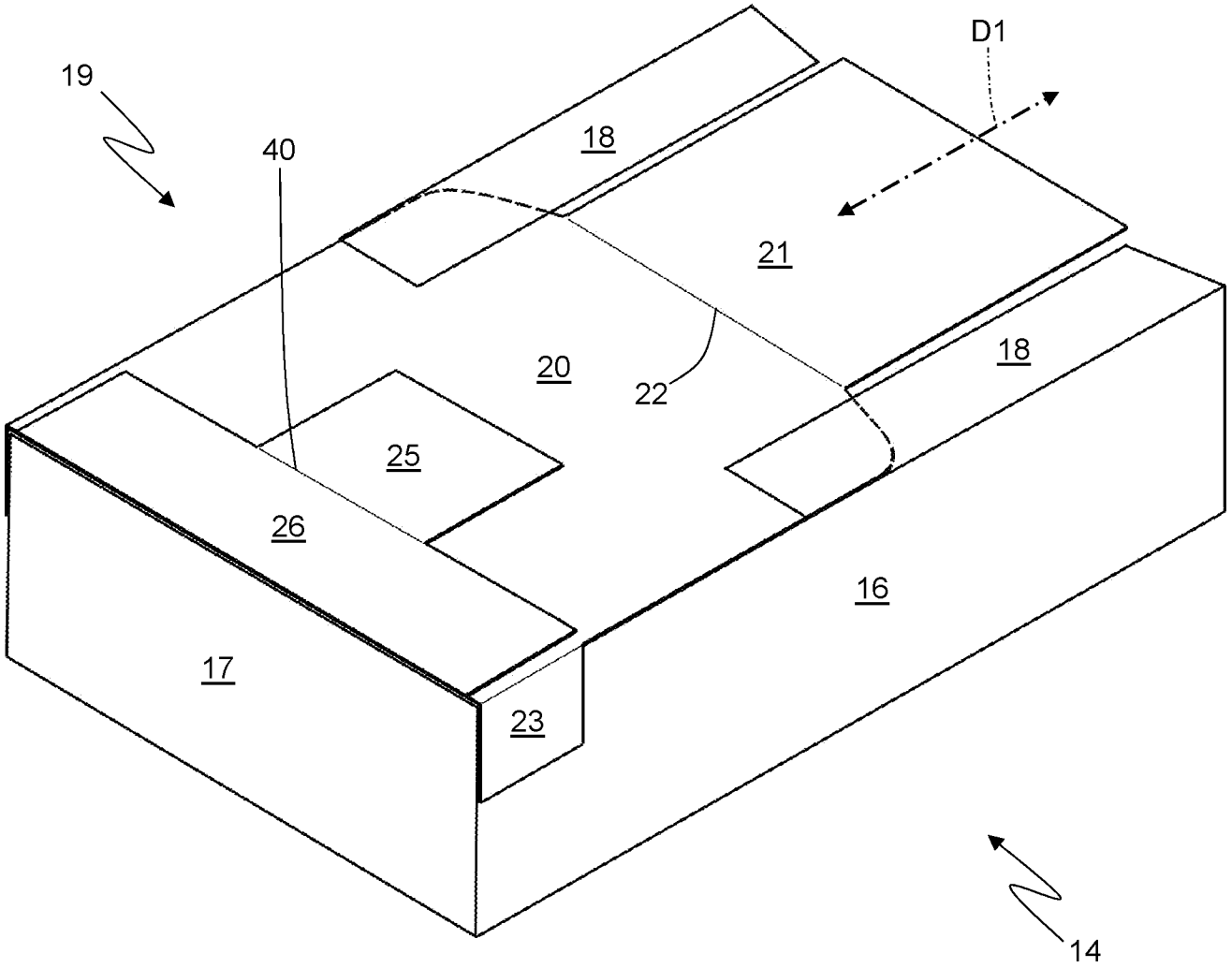
FIG. 6 is a perspective view of a collar and slider of the cigarette pack in FIG. 1 in a reciprocal position corresponding to the closed lid.
Figure 7:
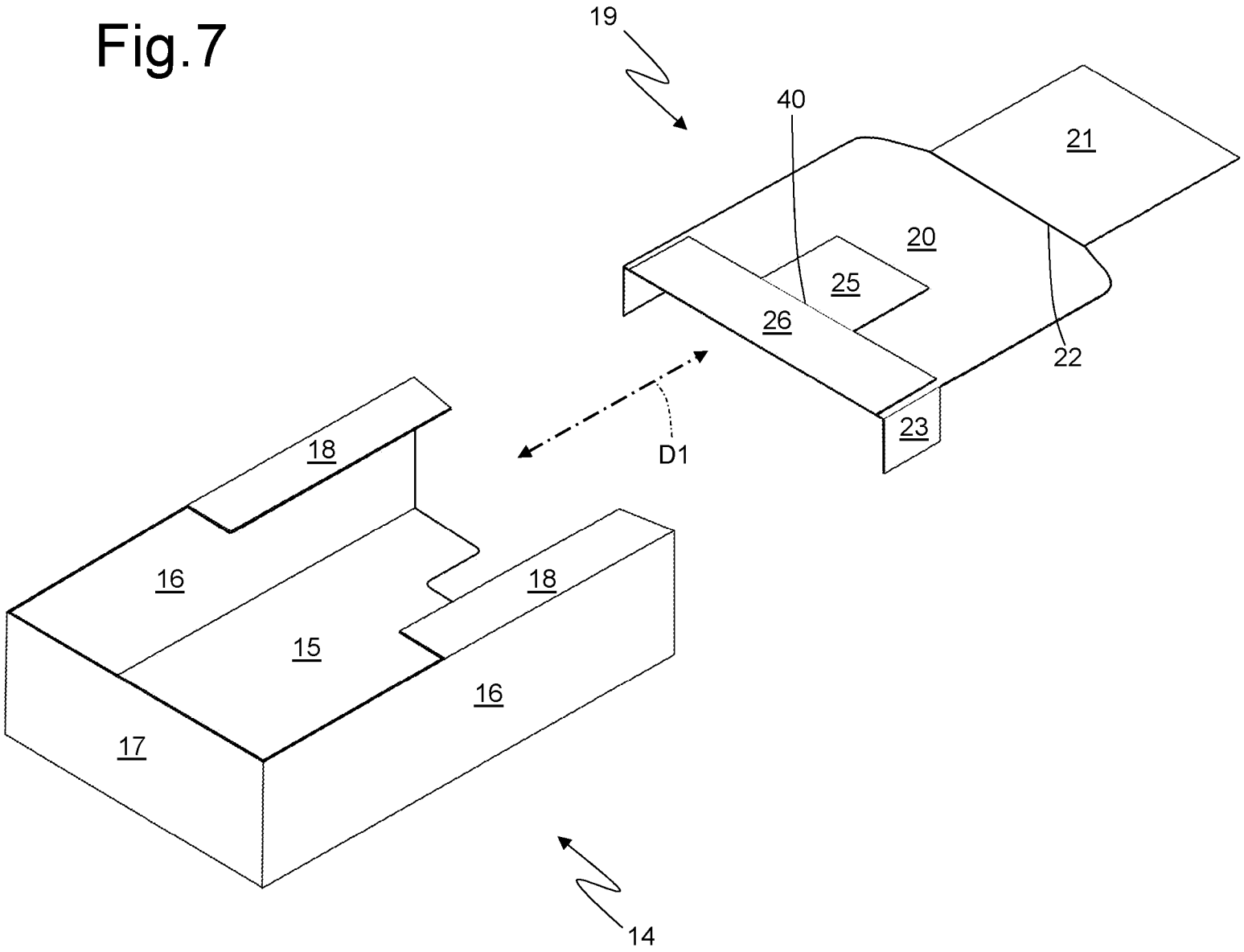
FIG. 7 is a perspective, exploded view of the collar and slider in FIG. 6.

As shown in FIGS. 2, 6 and 7, the pack 1 further comprises, a collar 14, which embraces the inner wrap 13 and is glued on the inside of the container 2 so as to partially project out of the open top end 3 and engage a corresponding inner surface of the lid 4, when the lid 4 is arranged in the closed position described.

As illustrated in FIGS. 6 and 7, the collar 14 comprises a front wall 15, which is in contact with the front wall 7 of the container 2, two side walls 16, which are arranged on opposite sides of the front wall 15 and are in contact with the side walls 8 of the container 2, and a bottom wall 17, which is in contact with the bottom wall 5 of the container 2. Each side wall 16 of the collar 14 comprises a rear flap 18, which is folded perpendicular (i.e. at 90°) to the side wall 16 and is arranged in contact with the rear wall 7 of the container 2.

In addition, the pack 1 comprises a slider 19, which is arranged partially in contact with the rear wall 7 of the container 2 and is permanently connected to the lid 4. The slider 19 has a rear wall 20 which is in contact with the rear wall 7 of the container 2 and a rear wall 21 (i.e. connection panel) which is connected to the rear wall 20 by a hinge 22 and is in contact with the rear wall 11 of the lid 4; in particular, the rear wall 20 of the slider 19 is only resting on the rear wall 7 of the container 2 and can therefore slide linearly with respect to said rear wall 7 along a sliding direction D1 while the rear wall 21 of the slider 19 is glued (by permanent glue) to the rear wall 11 of the lid 4 and is therefore rigidly and firmly fixed to said rear wall 11. The hinge 22 connecting the two rear walls 20 and 21 of the slider 19 allows the lid 4 (glued to the rear wall 21 of the slider 19) to rotate between the closed position (illustrated in FIGS. 1 and 3) and the open position (illustrated in FIGS. 2 and 5); in other words, the hinge 22 connecting the two rear walls 20 and 21 of the slider 19 constitutes the hinge of the lid 4 and allows the rotation of said lid 4. As mentioned above, the rear wall 20 of the slider 19 is only resting on the rear wall 7 of the container 2 so that it can slide freely along the direction D1 of sliding with respect to said rear wall 7; preferably, the rear wall 20 of the slider 19 is placed under the rear flaps 18 of the collar 14 (i.e. between the rear flaps 18 of the collar 14 and the inner wrap 13) and slides freely with respect to the container 2, with respect to the inner wrap 13 and with respect to the collar 14.

According to a preferred embodiment, the rear wall 20 of the slider 19 has a pair of tabs 23, which are folded perpendicular (i.e. 90°) with respect to said rear wall 20 and against the side walls 16 of the collar 14 on the opposite side to the inner wrap 13. The function of the tabs 23 is to limit the sliding of the slider 19 upwards; in particular, if the rear wall 20 of slider 19 is placed under the rear flaps 18 of the collar 14, the sliding of the slider 19 upwards is blocked when the tabs 23 reach the rear flaps 18 of the collar 14.

FIGS. 3, 4 and 5 show the opening phases of the lid 4; in particular, FIG. 3 laterally shows the cigarette pack 1 with the lid 4 in the closed position, FIG. 4 shows the cigarette pack 1 with the lid 4 in an intermediate position, and FIG. 5 shows the cigarette pack 1 with the lid 4 in the open position. To move from the closed position to the open position, the lid 4 is initially lifted with respect to the container 2 by means of a longitudinal translation (i.e. parallel to the longitudinal edges) which takes place along the sliding direction D1 (this lifting brings the lid 4 from the closed position to the open position); the lifting of the lid 4 with respect to the container 2 takes place as a result of sliding the slider 19 upwards and ends when the tabs 23 of the slider 19 reach the rear flaps 18 of the collar 14. Once the translation of the lid 4 with respect to the container 2 (FIG. 4) is complete, the lid 4 is rotated with respect to the container 2 around the hinge 22 until it reaches the open position (FIG. 5).

Figure 8:
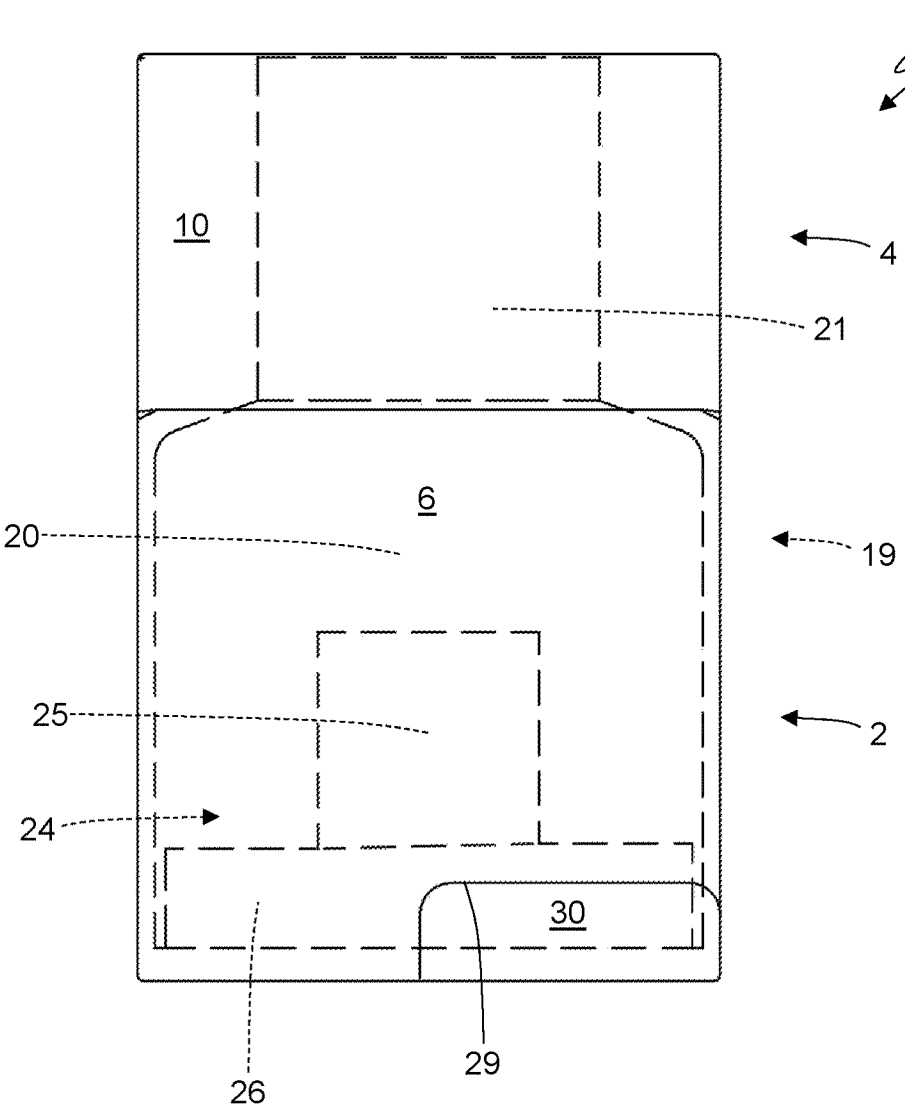
FIG. 8 is a rear view of the cigarette pack in FIG. 1 in a closed configuration.
Figure 13:
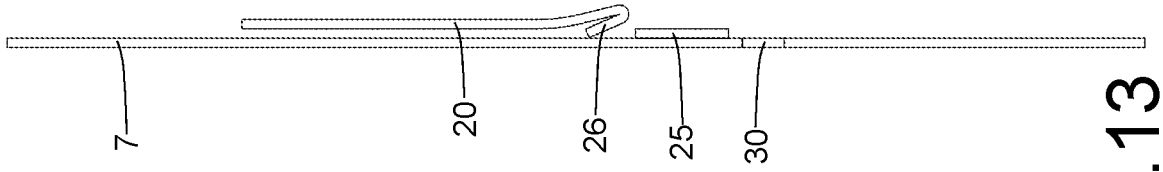
FIGS. 10-13 schematically illustrate the operation of a locking system of the sliding of the lid in the cigarette pack in FIG. 1.
Figure 12:
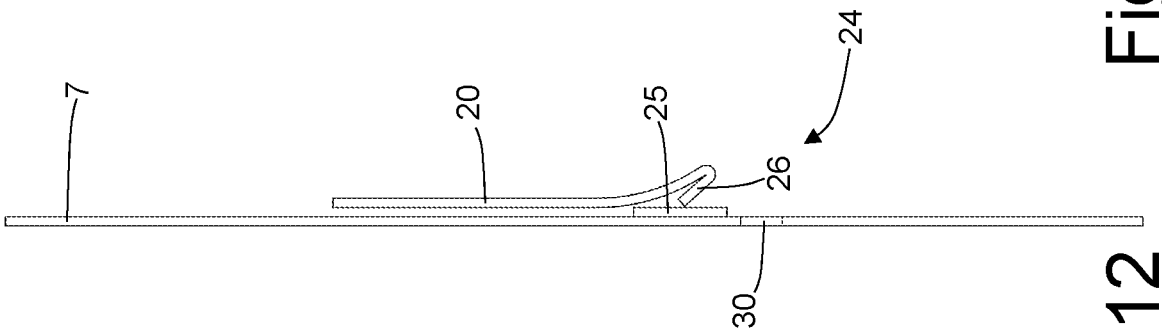

As shown in FIG. 8, the cigarette pack 1 also comprises a locking system 24 which is interposed between the container 2 and the slider 19 and, in the closed position of the lid 4, prevents (in a manner which can be deactivated by an external action of the user) the slider 19 from sliding with respect to the container 2. In other words, the locking system 24 keeps the slider 19 (therefore the lid 4 which is glued to the slider 19) in the closed position of the lid 4 (shown in FIGS. 1, 3 and 8) locking (preventing) the slider 19 from sliding with respect to the container 2; this hindering of the sliding of the slider 19 with respect to the container 2 by the locking system 24 can be deactivated by an external action of the user when said user wishes to open the cigarette pack 1 (i.e. when he wants to slide the slider 19 and thus the lid 4, with respect to the container 2 to bring the lid 4 into the open position).

Figure 10:
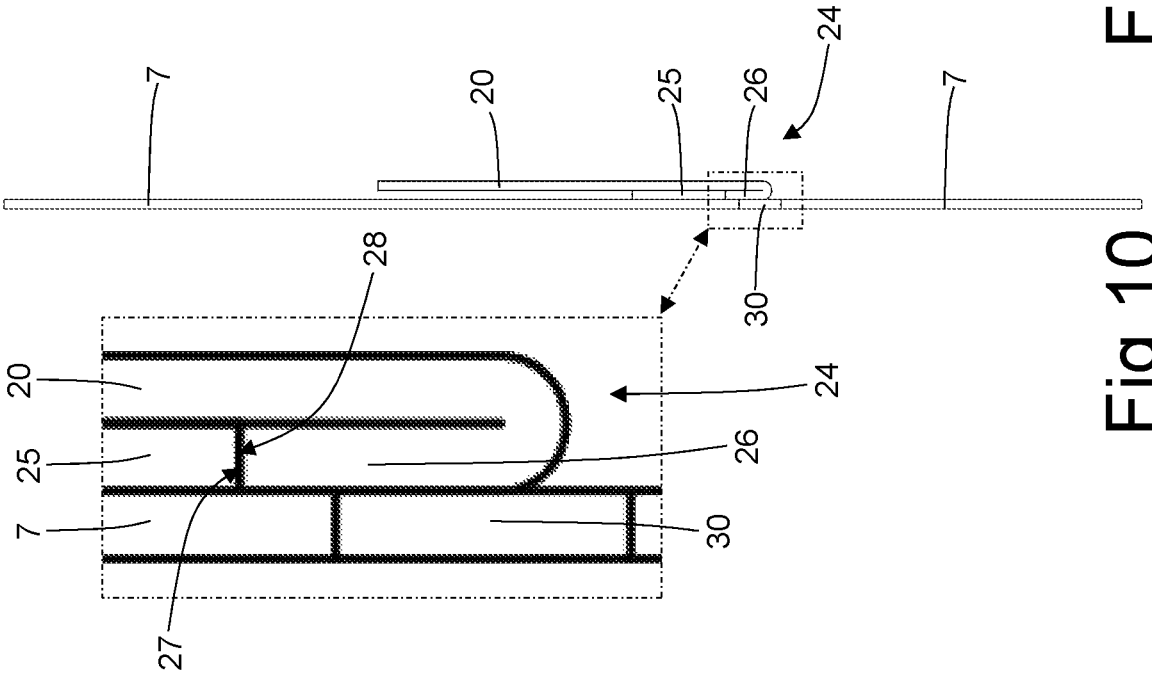

In the embodiment shown in FIGS. 8 and 10, the locking system 24 comprises a stop tab 25 (i.e. contrast panel) which is integral with the rear wall 7 of the container 2, is arranged in an intermediate position in the rear wall 7 of the container 2, and projects so as to overhang the rear wall 7 of the container 2 towards the inside of the container 2; in addition, the locking system 24 comprises a stop tab 26 which is part of the slider 19, is folded 180° against the rear wall 20 of the slider 19, is glued to the rear wall 20 of the slider 19, and has a free edge 27 which is capable of resting on a corresponding free edge 28 of the stop tab 25 in the absence of deformations externally imposed.

In the closed position of the lid 4 (illustrated in FIGS. 1, 3, 8 and 10) and in the absence of deformations externally imposed, the free edge 27 of the stop tab 26 (which is part of the slider 19 and is attached to said slider 19) is facing and aligned (substantially resting) with the free edge 28 of the stop tab 25 (which projects from the rear wall 7 of the container 2 and is attached to said rear wall 7); in this situation, if a user tries to move the lid 4 in relation to the rest of the container 2, he is unable to do so because the sliding movement of the lid 4 (permanently connected to the slider 19) is blocked by the contact between the stop tab 26 (which is attached to said slider 19) and the stop tab 25 (which is attached to the rear wall 7 of the container 2), i.e. the interference between the two stop tabs 25 and 26 prevents the slider 19 (i.e. lid 4) from moving in relation to the container 2.

Figure 11:
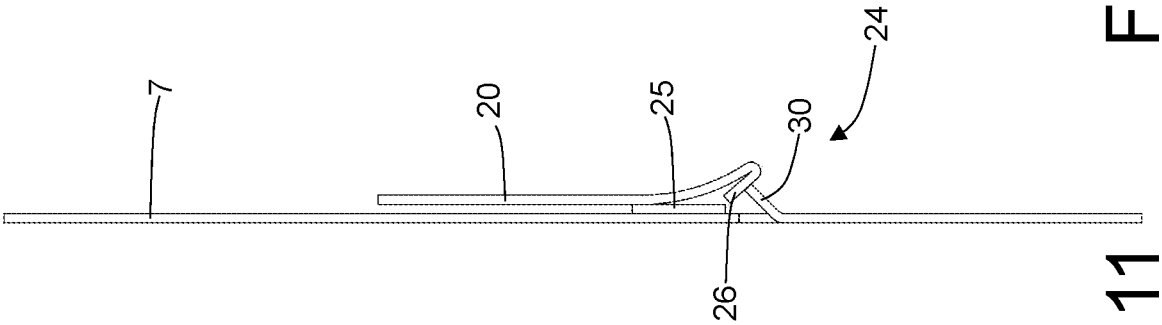

As shown in FIG. 11, by externally applying an elastic deformation to the cigarette pack 1, it is possible to misalign the free edge 27 of the stop tab 26 with the free edge 28 of the stop tab 25 and in this situation the slider 19 (i.e. the lid 4) can move with respect to the container 2 because during translation the free edge 27 of the stop tab 26 no longer comes into contact with the free edge 28 of the stop tab 25. This elastic deformation of the cigarette pack 1 can be achieved in two different and alternative ways: by pressing on the rear wall 7 of the container 2 near (at) the stop tab 26 to deform (arch) the rear wall 7 of the container 2 inwards (i.e. make a "belly" towards the rear wall 7 of the container 2) so as to push said stop tab 26 inwards (as shown in FIG. 11) or by compressing the two side walls 8 of the container 2 towards each other to deform (arch) the rear wall 7 of the container 2 outwards (i.e. make a "belly" towards the rear wall 7 of the container 2) and thus push the stop tab 25 outwards. In other words, by externally applying an elastic deformation to the cigarette pack 1, it is possible to misalign the free edge 27 of the stop tab 26 with the free edge 28 of the stop tab 25 and this elastic deformation can be obtained by pressing inwards on at least one outer wall 7 or 8 of the container 2 to obtain an elastic deformation of at least part of the outer rear wall 7 of the container 2 (i.e. to deform/bend inwards or outwards the outer rear wall 7 of the container 2); i.e., the hindering of the sliding of the slider 19 in relation to the container 2 determined by the locking system 24 can be deactivated by pressing inwards on at least one of the outer walls 7 or 8 of the container 2 (i.e. by pressing inwards on at least one of the outer walls 7 or 8 of the container 2) in order to obtain an elastic deformation of at least part of the outer rear wall 7 of the container 2 (i.e. to deform/bend inwards or outwards the outer rear wall 7 of the container 2).

Pressing on the rear wall 7 of the container 2 at the stop tab 26 deforms part of the rear wall 7 of the container 2 which pushes on the stop tab 26 so as to push the stop tab 26 inwards and thus move the stop tab 26 away from the stop tab 25 (as shown in FIG. 11). Pressing the two side walls 8 of the container 2 towards each other slightly deforms the two side walls 8 of the container 2 and above all deforms (arching) the rear wall 7 of the container 2 (to which the stop tab 25 is glued) moving the stop tab 25 away from the stop tab 26.

As shown in FIG. 8, in order to increase the deformation capacity of the rear wall 7 of the container 2 towards the inside, said rear wall 7 has a through cut 29 that delimits and defines a button 30 (the cut 29 that delimits and defines the button 30 has a "U" shape with three straight sides connected by small curves); in other words, the part of the rear wall 7 of the container 2 enclosed in the cut 29 is the button 30 which can be pushed inwards (detaching from the rest of the rear wall 7 of the container 2 as shown in FIG. 11) to in turn push the stop tab 26. According to a possible embodiment, the button 30 may have a particular graphic that highlights it in comparison to the rest of the back wall 7 of the container 2 and possibly instructing the user to press said button 30. According to a different embodiment, not shown, the rear wall 7 of the container 2 has no cut 29 and therefore no button 30.

Figure 9:
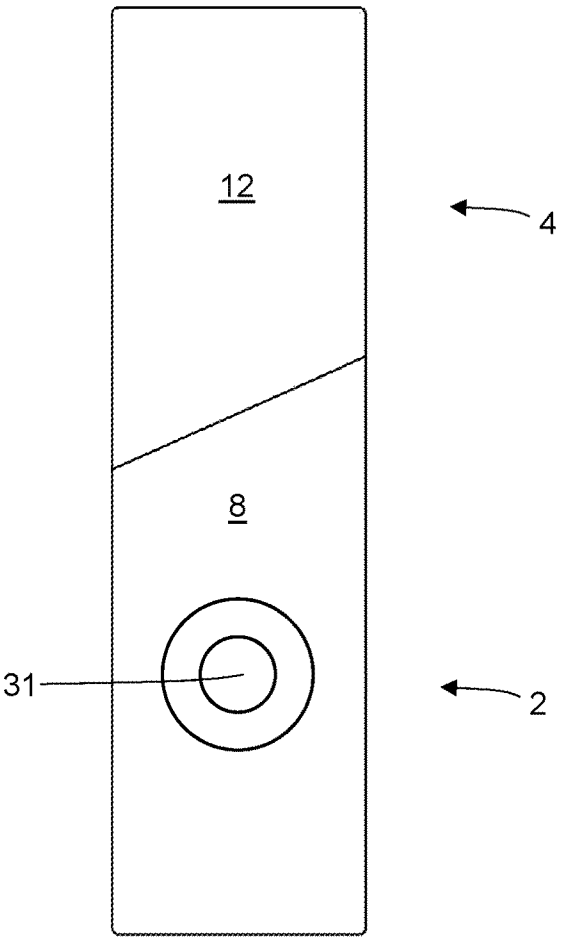
FIG. 9 is a side view of the cigarette pack in FIG. 1 in a closed configuration.

According to a possible (but not exclusive) embodiment illustrated in FIG. 9, the two side walls 8 of the container 2 have graphic symbols 31 that indicate to the user where to compress the two side walls 8 (this embodiment is normally present in the absence of the button 30).

Figure 14:
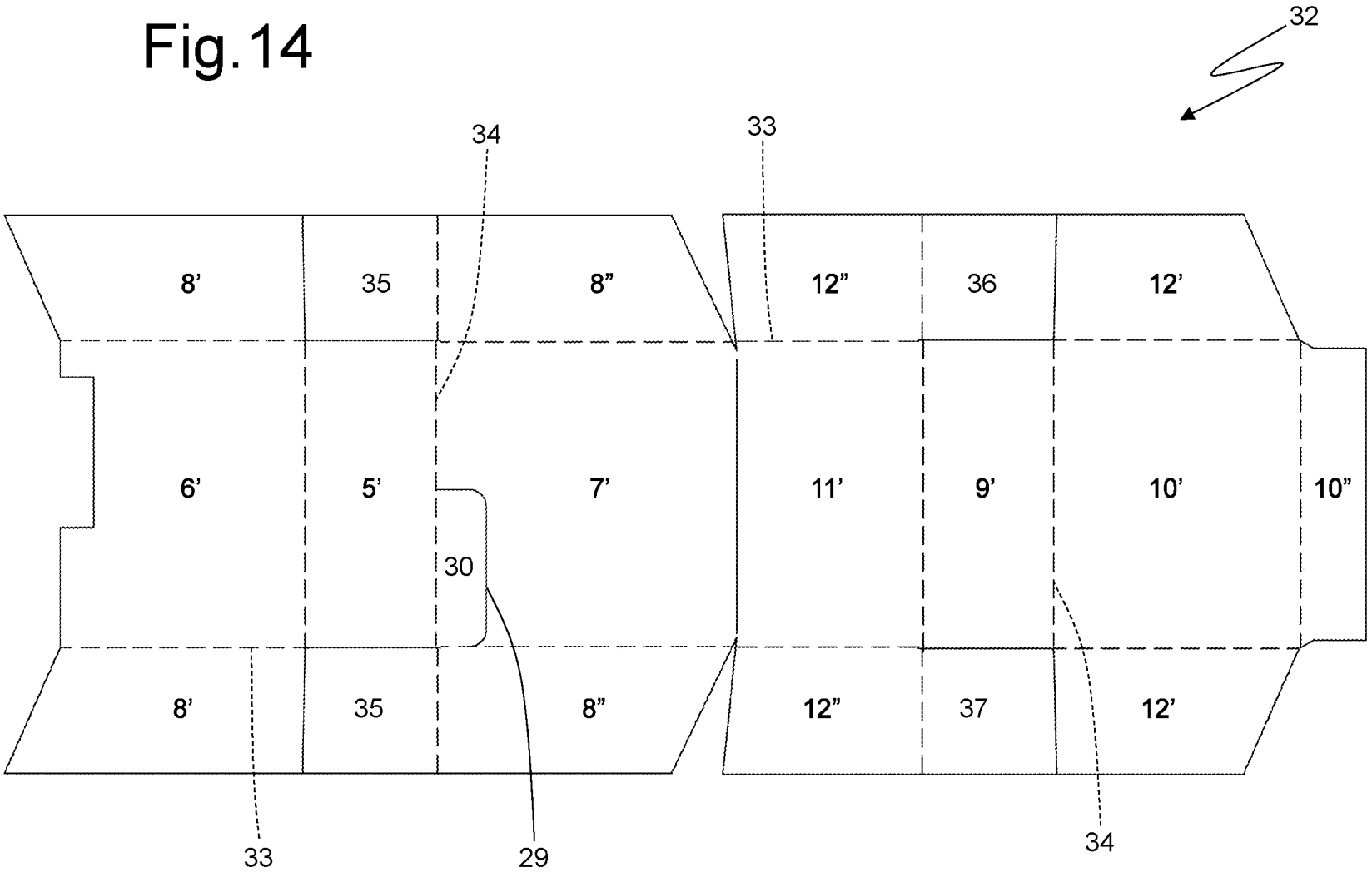
FIG. 14 is a plan view of a spread out, cut-out used to form a container with a lid of the cigarette pack in FIG. 1.

As shown in FIG. 14, the container 2 (and the lid 4 which is part of the container 2) is obtained by folding around the inner wrap 13 a flat cut-out 32 with a substantially elongated rectangular shape; in the following description, the parts of the cut-out 32 will be indicated, where possible, with accented reference numbers the same as the reference numbers distinguishing the corresponding parts of the container 2.

The cut-out 32 has two longitudinal (pre-weakened) folding lines 33 and a number of transversal (pre-weakened) folding lines 34, which define, between the two longitudinal folding lines 33, a panel 6' forming the front wall 6 of the container 2, a panel 5' forming the bottom wall 5 of the container 2, a panel 7' constituting the rear wall 7 of the container 2, a panel 11' constituting the rear wall 11 of the lid 4, a panel 9' constituting the upper wall 9 of the lid 4, a panel 10' constituting the front wall 10 of the lid 4, and a reinforcement tab 10" which is folded 180° towards the inside of the container 2 and glued against the panel 10'.

Each panel 6' or 7' has two side flaps 8' or 8', which are arranged on opposite sides of the respective panel 6' or 7', are separated from the respective panel 6' or 7' by longitudinal fold lines 33, and are overlapped and glued together to form the side walls 8 of the container 2. Each flap 8" of the panel 7' has a tab 35" that is folded 90° to the tab 8" and rests against the panel 5'.

Each panel 10' or 11' has two side flaps 12' or 12', which are arranged on opposite sides of the respective panel 10' or 11', are separated from the respective panel 10' or 11' by longitudinal fold lines 33, and are overlapped and glued together to form the side walls 12 of the lid 4. Each flap 12" of the panel 11' has a tab 36" that is folded 90° to the tab 12" and rests against the panel 9'.

It is important to emphasise that in the cut-out 32 the panel 11' (i.e. the rear wall 11 of the lid 4) is permanently and firmly connected to the panel 7' (i.e. the rear wall 7 of the container 2); therefore, when making the cigarette pack 1, it is necessary to make an incision or a clean cut on the cut-out 32 along a separation line in order to separate the rear wall 11 of the lid 4 from the back wall 7 of the container 2. In other words, the cut-out 32 is cut along the separation line so that the rear wall 11 of the lid 4 is completely separate from the rear wall 7 of the container 2.

Figure 15:
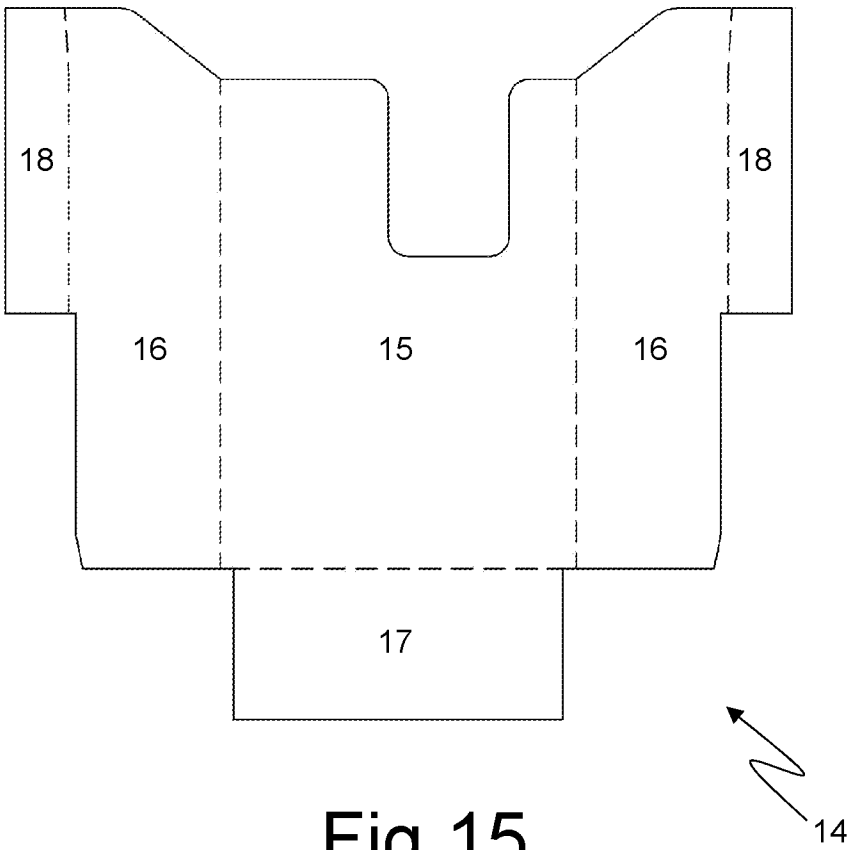
FIG. 15 is a plan view of a spread-out collar used to form the cigarette pack in FIG. 1.

FIG. 15 shows the collar 14 spread out and with all its parts highlighted, i.e.: the front wall 15, the two side walls 16, the bottom wall 17, and the two rear flaps 18.

Figure 16:
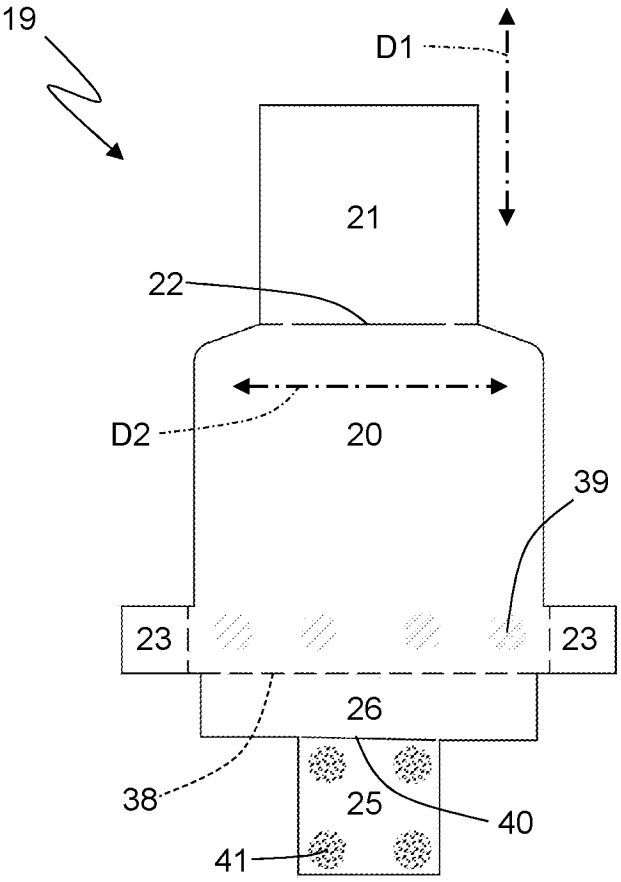
FIG. 16 is a plan view of a spread-out slider used to form the cigarette pack in FIG. 1.

FIG. 16 shows the slider 19 spread out and with all its parts highlighted, i.e.: the rear wall 20, the rear wall 21 (connected to the rear wall 20 along the hinge 22), the two tabs 23, the stop tab 25 and the stop tab 26.

According to a preferred (but not binding) embodiment shown in FIG. 16, the stop tab 26 is connected to the rear wall 20 of the slider 19 along a folding line 38 (pre-weakened), is bent 180° against the rear wall 20, and is glued to said rear wall 20 using permanent glue 39 (schematically shown in FIG. 16).

In addition, according to a preferred (but not binding) embodiment shown in FIG. 16, the stop tab 25 is (only initially) connected to the stop tab 26 of the slider 19 along a tearable (pre-weakened) line 40, it is glued to the rear wall 7 of the container 2 by means of permanent glue 41 (schematically shown in FIG. 16), and is torn from the stop tab 25 (by tearing the wrap along the tearable line 40) the first time the cigarette pack 1 is opened (i.e. the first time the lid 4 is opened and therefore the first time the button 30 or the graphic symbols 31 are pressed). In other words, the stop tab 26 at one end is permanently connected to the rear wall 20 of the slider 19 along the fold line 38 while the opposite end is (initially and temporarily) connected to the stop tab 25 along the tearable line 40 (which breaks the first time the cigarette pack 1 is opened).

Figure 17:
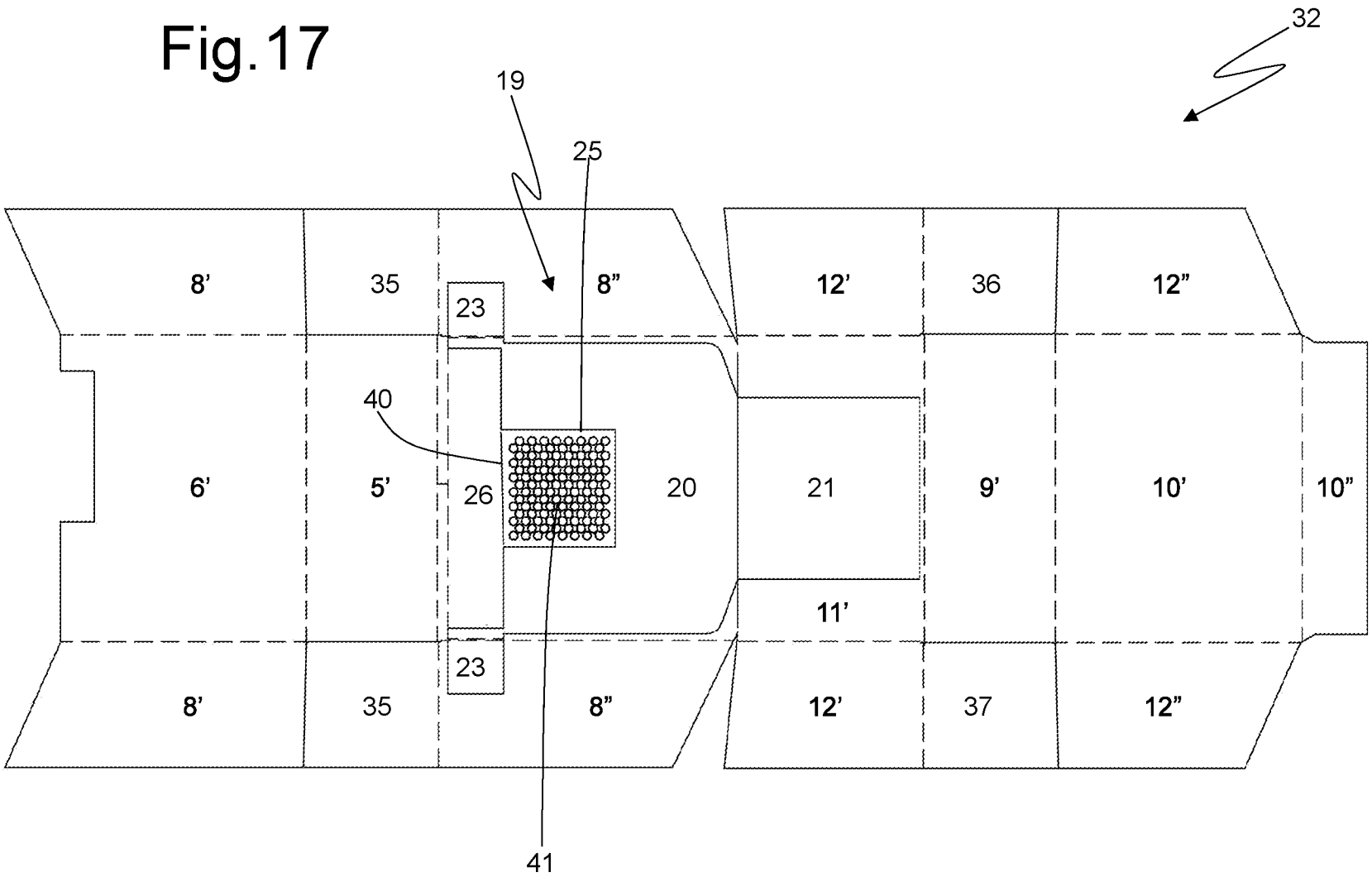
FIG. 17 illustrates the cut-out of FIG. 14 coupled to the partially folded slider of FIG. 16.

The packaging machine described in patent application EP1884467A1, Italian patent application BO2007A000039 or Italian patent application BO2007A000490 could be used to produce the cigarette pack 1 described above. In these known packaging machines, the slider 19 is coupled to the inner wrap 13 (and thus folded around the inner wrap 13) before coupling the cut-out 32 to the inner wrap 13; according to alternative embodiments the slider 19 can be coupled to the inner wrap 13 (and thus folded around the inner wrap 13) before or after coupling the collar 14 to the inner wrap 13. According to a possible variant of the known packaging machines illustrated in FIG. 17, the slider 19 is previously coupled and glued (either by means of permanent glue 41 between the stop tab 25 and the rear wall 7 of the container 2, or by means of permanent glue between the rear wall 21 of the slider 19 and the rear wall 11 of the lid 4) to the cut-out 32 and thus the cut-out 32 with the slider 19 (which at this point constitutes a unit that can no longer be divided) is folded around the inner wrap 13 already fitted with the collar 19.

According to a preferred embodiment shown in FIG. 16, the fibres of the material (paper) making up the slider 19 are oriented in a direction D2 perpendicular to the sliding direction D1 (and therefore parallel to the fold line 38, parallel to the transverse edges of the container 2 and lid 4, and perpendicular to the longitudinal edges of the container 2 and lid 4). In fact, when the fibres of the material (paper) making up the slider 19 are parallel to the direction D2, the slider 19 flexes less longitudinally and therefore allows better operation of the locking system 24 (i.e. it is less likely for the locking system 24 not to work properly, in the desired way). In other words, when the fibres of the material (paper) making up the slider 19 are parallel to the direction D2, the slider 19 has a greater bending rigidity in the longitudinal direction (i.e. along the sliding direction D1) and has a lower bending rigidity in the transverse direction (i.e. along the direction D2), therefore with the same stresses, the slider 19 deforms less longitudinally and deforms more transversely (to the advantage of the better functioning of the locking system 24).

Figure 18:
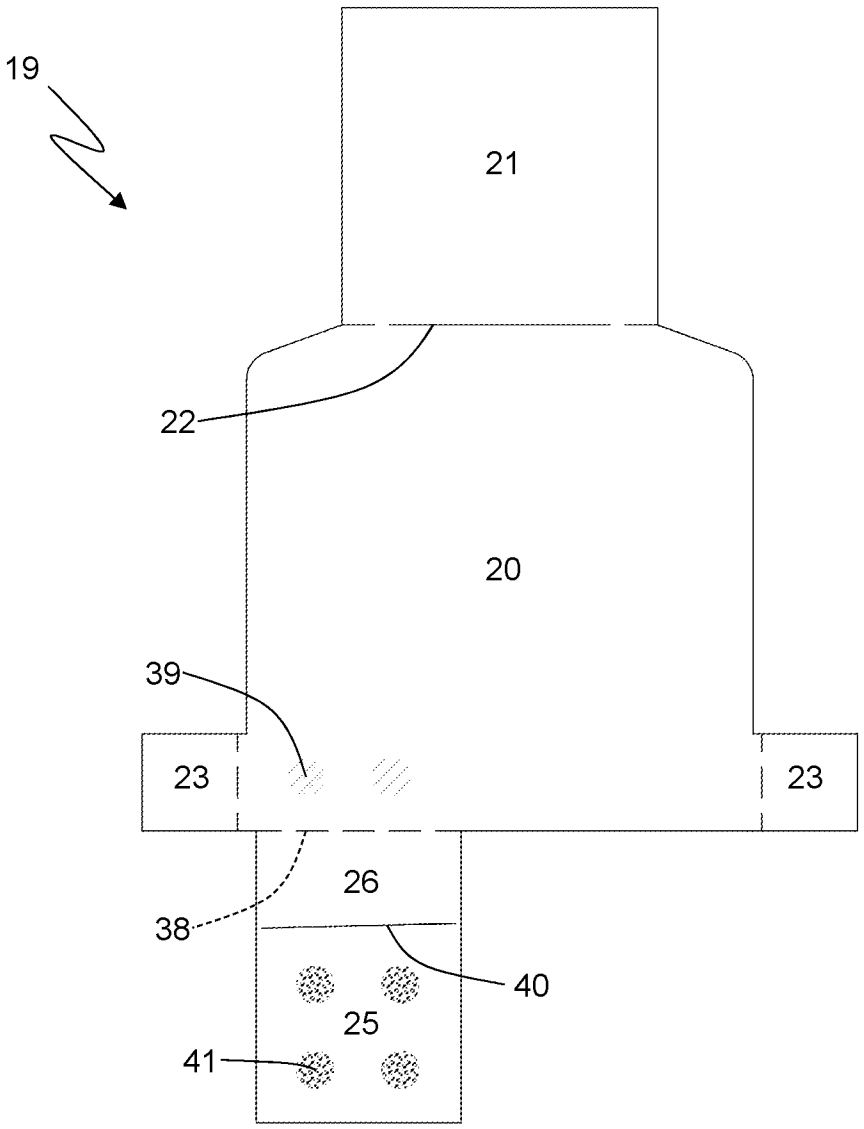
FIGS. 18 and 19 illustrate two variants of the slider in FIG. 16.

In the variant shown in FIG. 18, the two stop tabs 25 and 26 are smaller in size and arranged asymmetrically, i.e. closer to one side (right or left) of the slider 19 and further away from the other side (left or right) of the slider 19.

Figure 19:
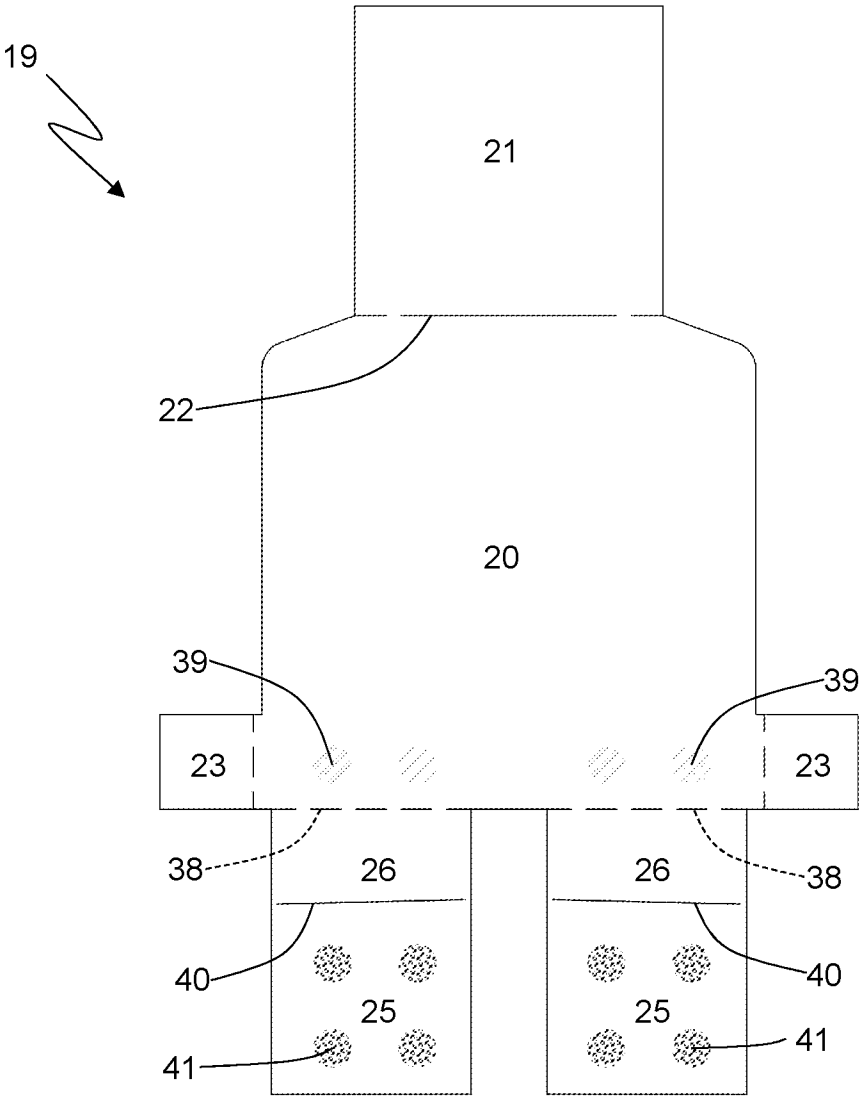

In the variant shown in FIG. 19, there are two stop tabs 25 and two corresponding stop tabs 26 on opposite sides (right and left) of the slider 19.

Figure 20:
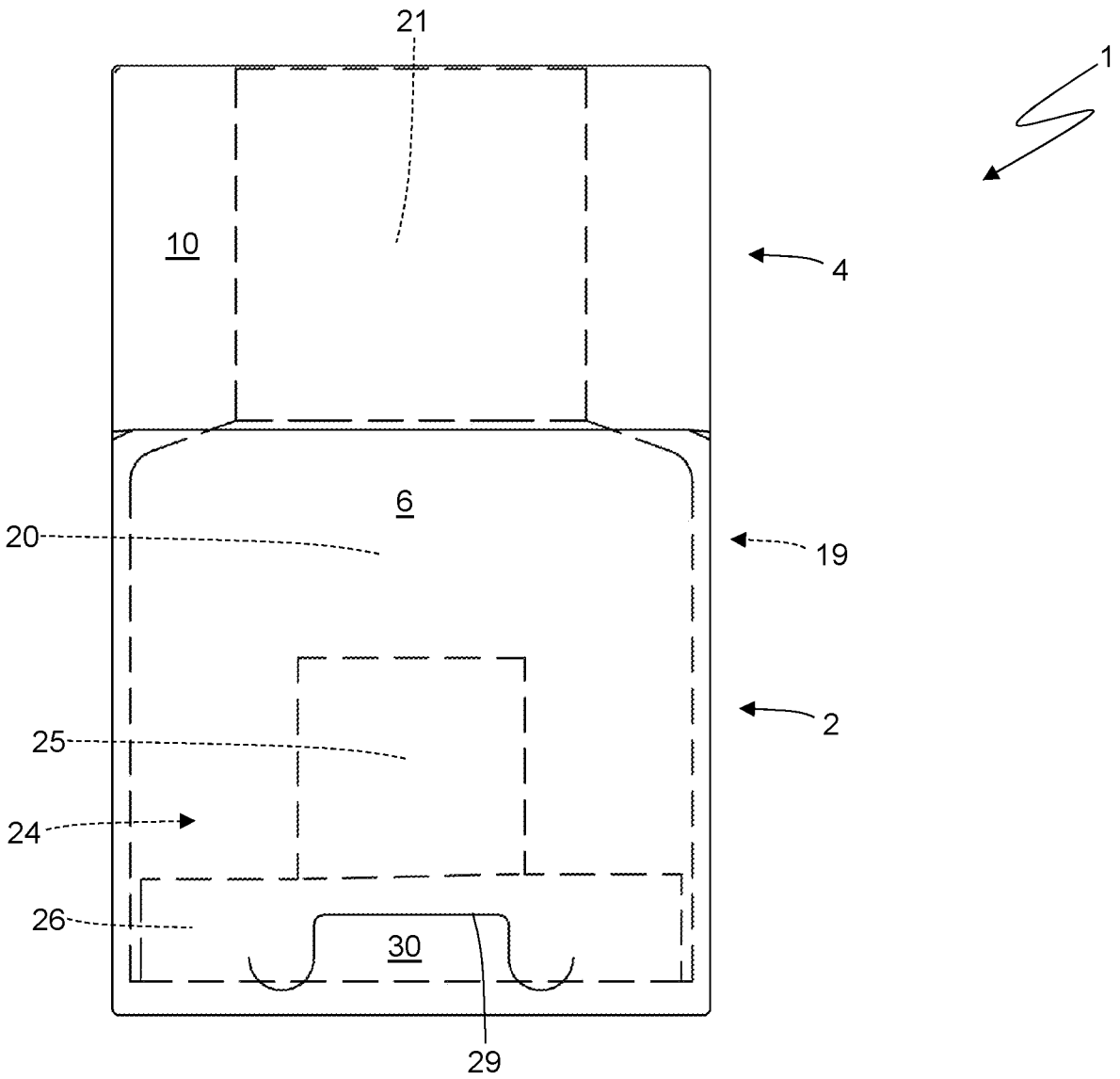
FIG. 20 is a rear view of a variant of the cigarette pack in FIG. 1 in a closed configuration.
Figure 21:
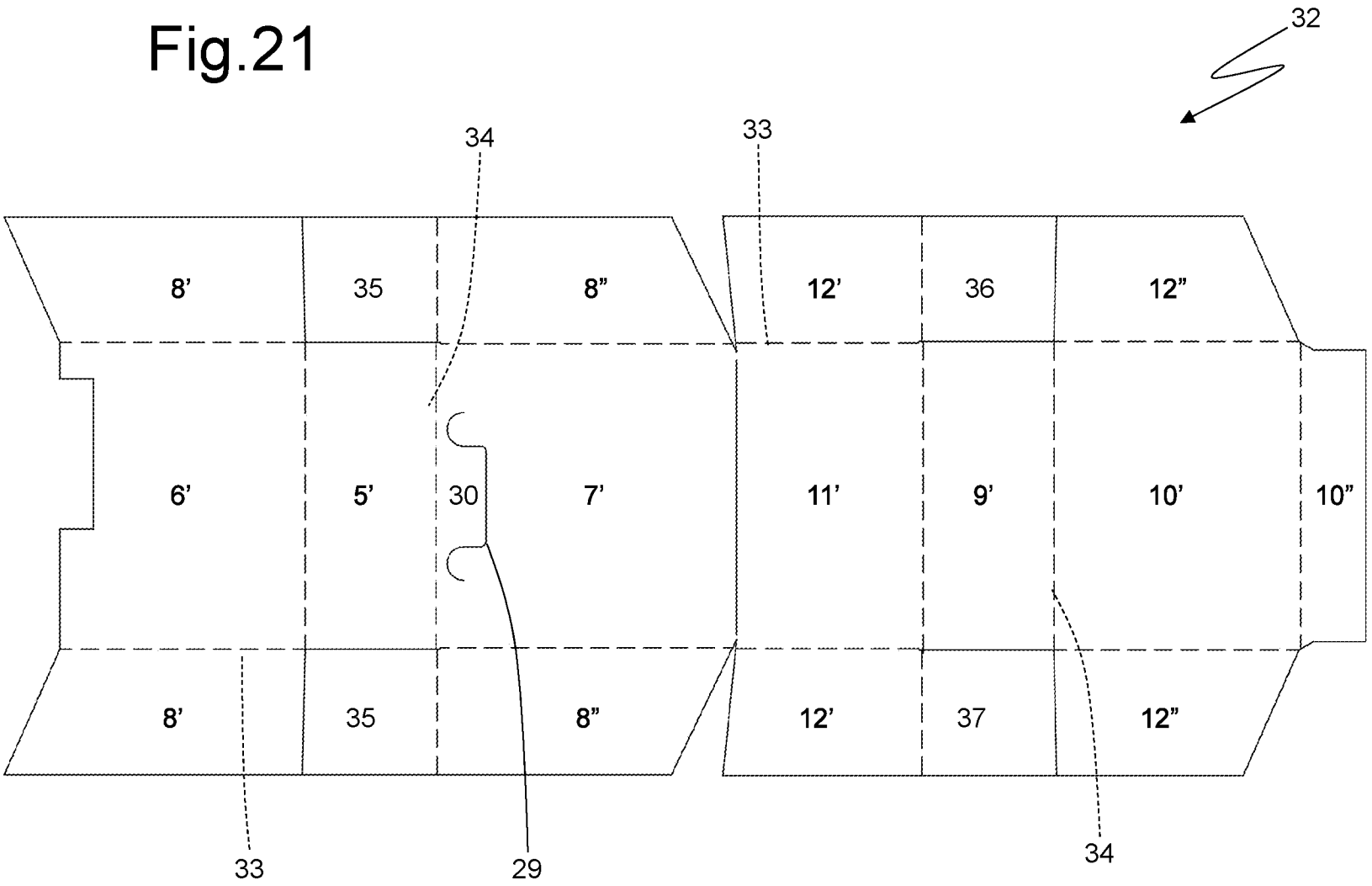
FIG. 21 is a plan view of a spread out, cut-out used to form a container with a lid of the cigarette pack in FIG. 20.

The embodiment shown in FIGS. 20 and 21 differs in the position of the button 30 and the shape of the cut 29 that delimits and defines the button 30. In the embodiment shown in FIGS. 8 and 14, the button 30 is placed offset (i.e. off-centre) in the rear wall 7 of the container 2, or the button 30 is placed on one side of the rear wall 7 of the container 2; in the embodiment shown in FIGS. 20 and 21, the button 30 is placed in the centre of the rear wall 7 of the container 2 (i.e. centred between the two lateral edges of the rear wall 7 of the container 2). In the embodiment illustrated in FIGS. 20 and 21, at the two opposite ends the cut 29 has two corresponding "curls", i.e. each end of the cut 29 ends with a curve (rounded) shaped like a "U" (i.e. having an extension of about 180°); the function of the two "curls" arranged at the opposite ends of the cut 29 is to prevent uncontrolled cuts (tears) that extend (in a totally undesirable way) the cut 29 particularly towards the fold line 34 arranged near the cut 29 (i.e. towards the fold line 34 connecting the rear wall 7 of the container 2 to the bottom wall 5 of the container 2). In fact, if uncontrolled (and unwanted) cuts (tears) extend the cut 29 up to the fold line 34 near said cut 29, the button 30 could rotate around the fold line 34 assuming a position that protrudes (in a totally unwanted way) from the rear wall 7 towards the inside of the container 2, without returning to the original position, coplanar to the rear wall 7, once the pressure exerted by the user is no longer present and making the locking function useless.

Figure 22:
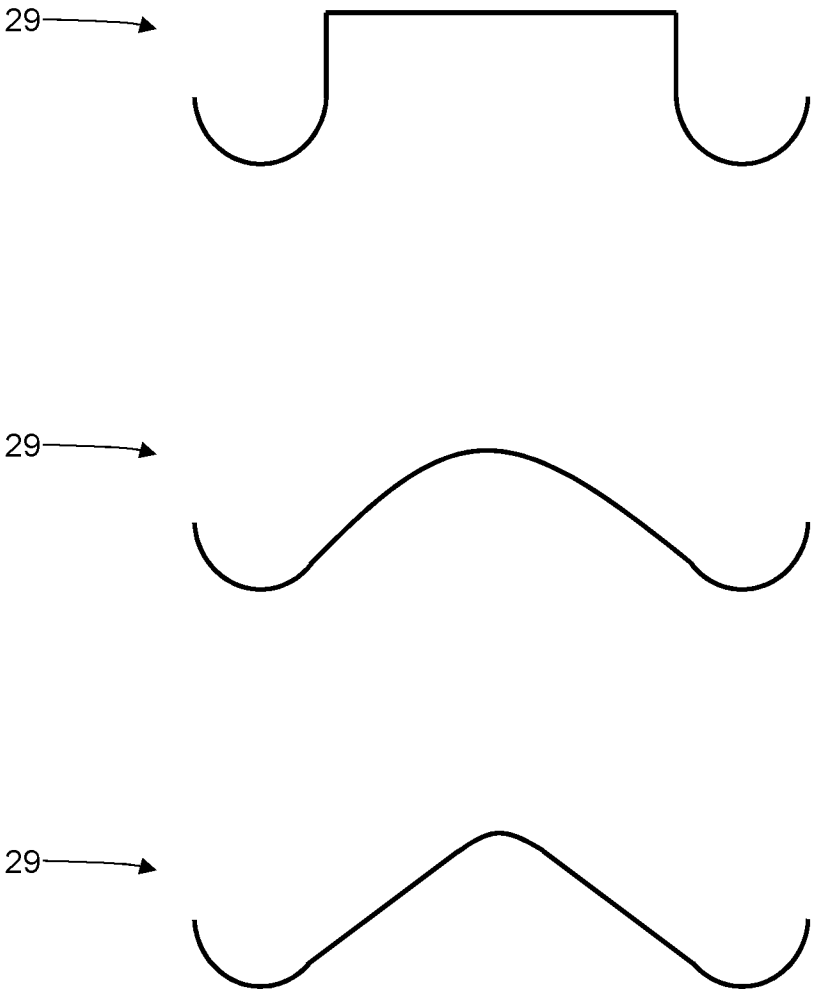
FIG. 22 illustrates some possible embodiments of a cut delimiting a button on the rear wall of a container of the cigarette pack in FIG. 20.
Figure 24:
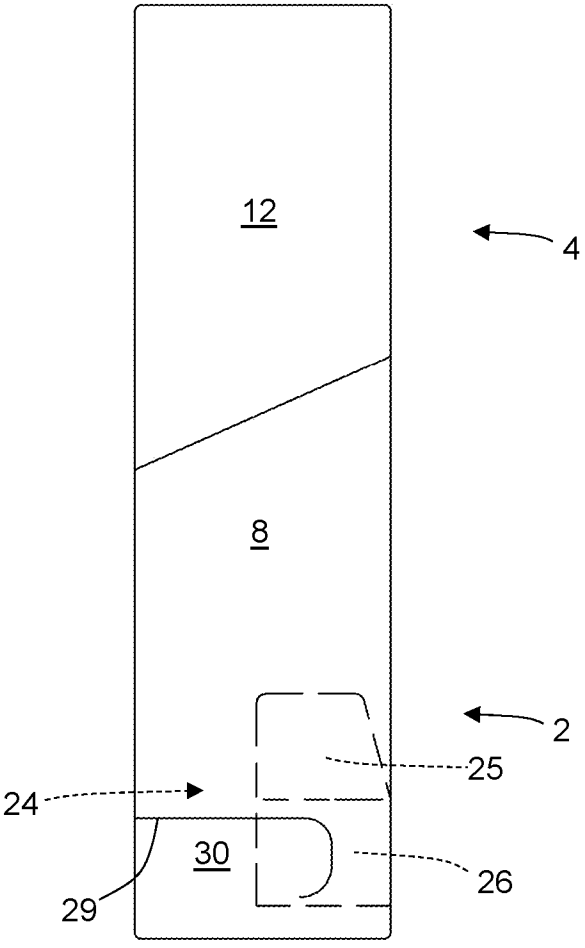
FIG. 24 is a side view of the cigarette pack in FIG. 23 in a closed configuration.
Figure 23:
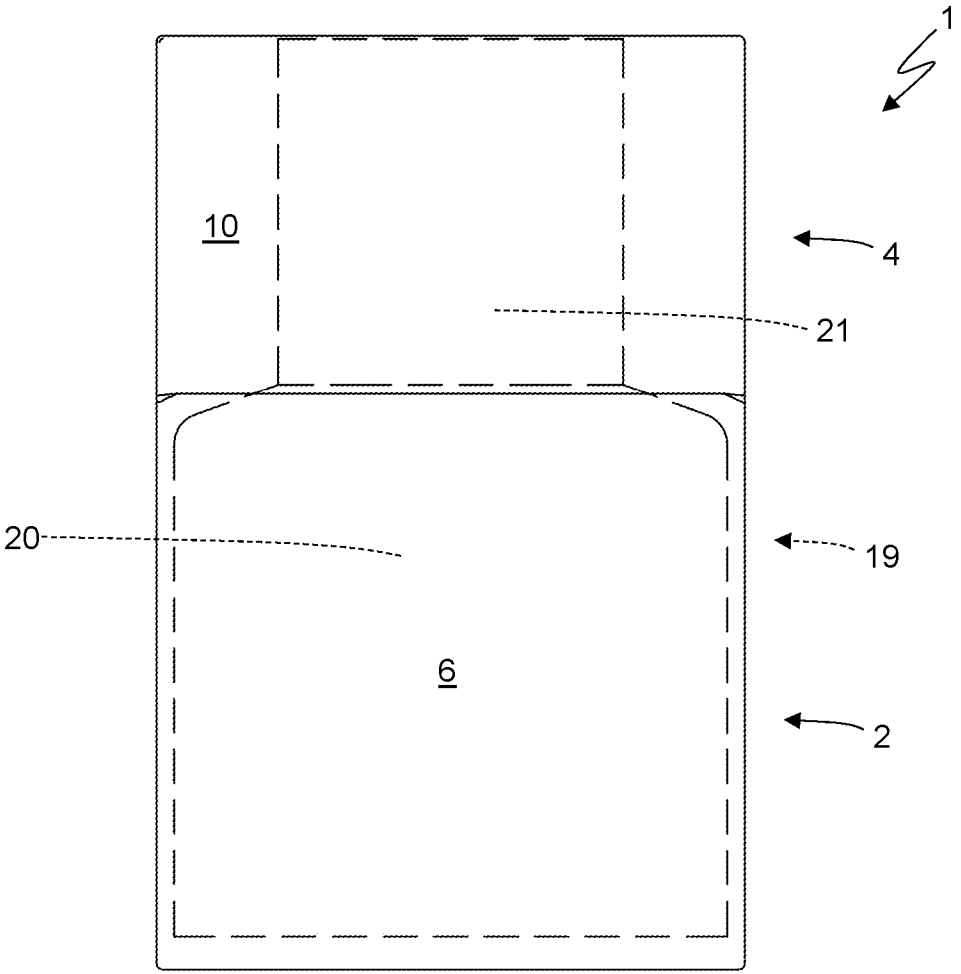
FIG. 23 is a rear view of a further variant of the cigarette pack in FIG. 1 in a closed configuration.
Figure 25:
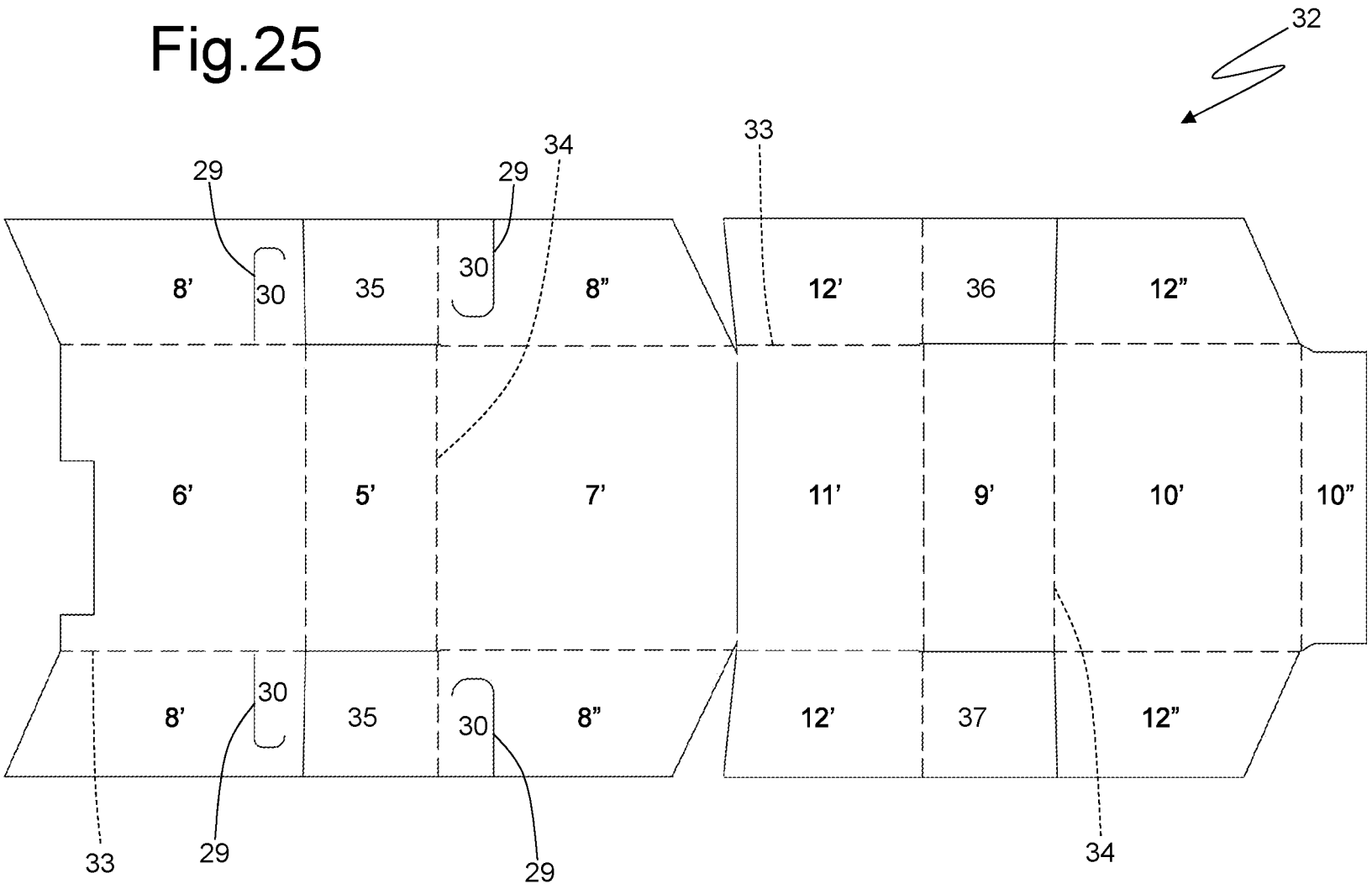
FIG. 25 is a plan view of a spread out, cut-out used to form a container with a lid of the cigarette pack in FIG. 23.
Figure 27:
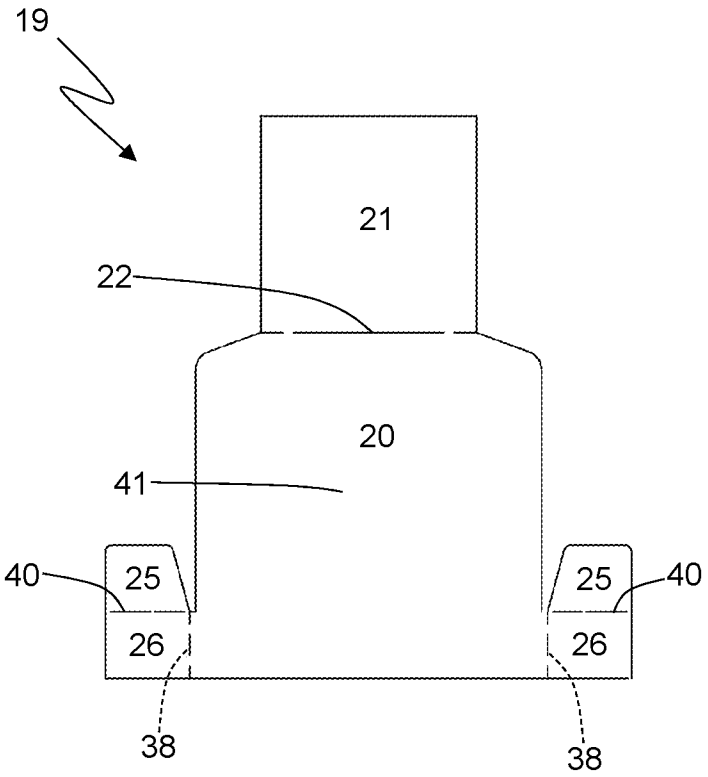
FIG. 27 is a plan view of a spread-out slider used to form the cigarette pack in FIG. 23.
Figure 26:
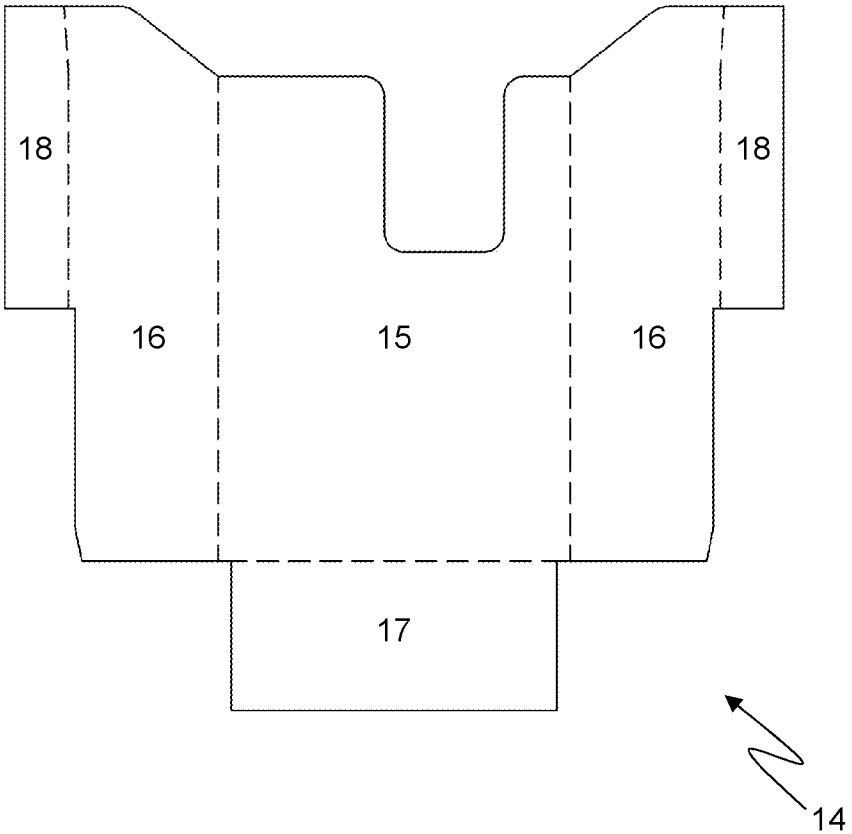
FIG. 26 is a plan view of a spread-out collar used to form the cigarette pack in FIG. 23.

FIG. 22 illustrates some possible shapes of the cut 29 that delimits and defines the button 30; a common element between the various shapes of the cut 29 is the presence of the two "curls" arranged at the opposite ends of the cut 29.

In the embodiment in FIGS. 1-22, the stop tabs 25 and 26 are arranged between the rear wall 7 of the container 2 and the rear wall 20 of the slider 19; in the alternative embodiment illustrated in FIGS. 23-28, the stop tabs 25 and 26 are arranged at the side walls 8 of the container 2. In particular there are two stop tabs 25 and 26 at the right side wall 8 of the container 2 and two additional stop tabs 25 and 26 at the left side wall 8 of the container 2; according to a different and equivalent embodiment, the locking system 24 is asymmetrical and has only one stop tab 25 and only one corresponding stop tab 26 placed on a single side wall 8 (right or left) of the container 2.

In this embodiment, each stop tab 26 is folded by 90° with respect to the rear wall 20 of the slider 19 to be in contact with a corresponding side wall 8 of the container 2 and each stop tab 25 is glued to a corresponding side wall 8 of the container 2 by means of permanent glue 41 (shown in FIG. 28); obviously in this embodiment there is no permanent glue 39 as the stop tabs 26 are perpendicular to the rear wall 20 of the slider 19 and are therefore no longer glued to said rear wall 20.

Figure 28:
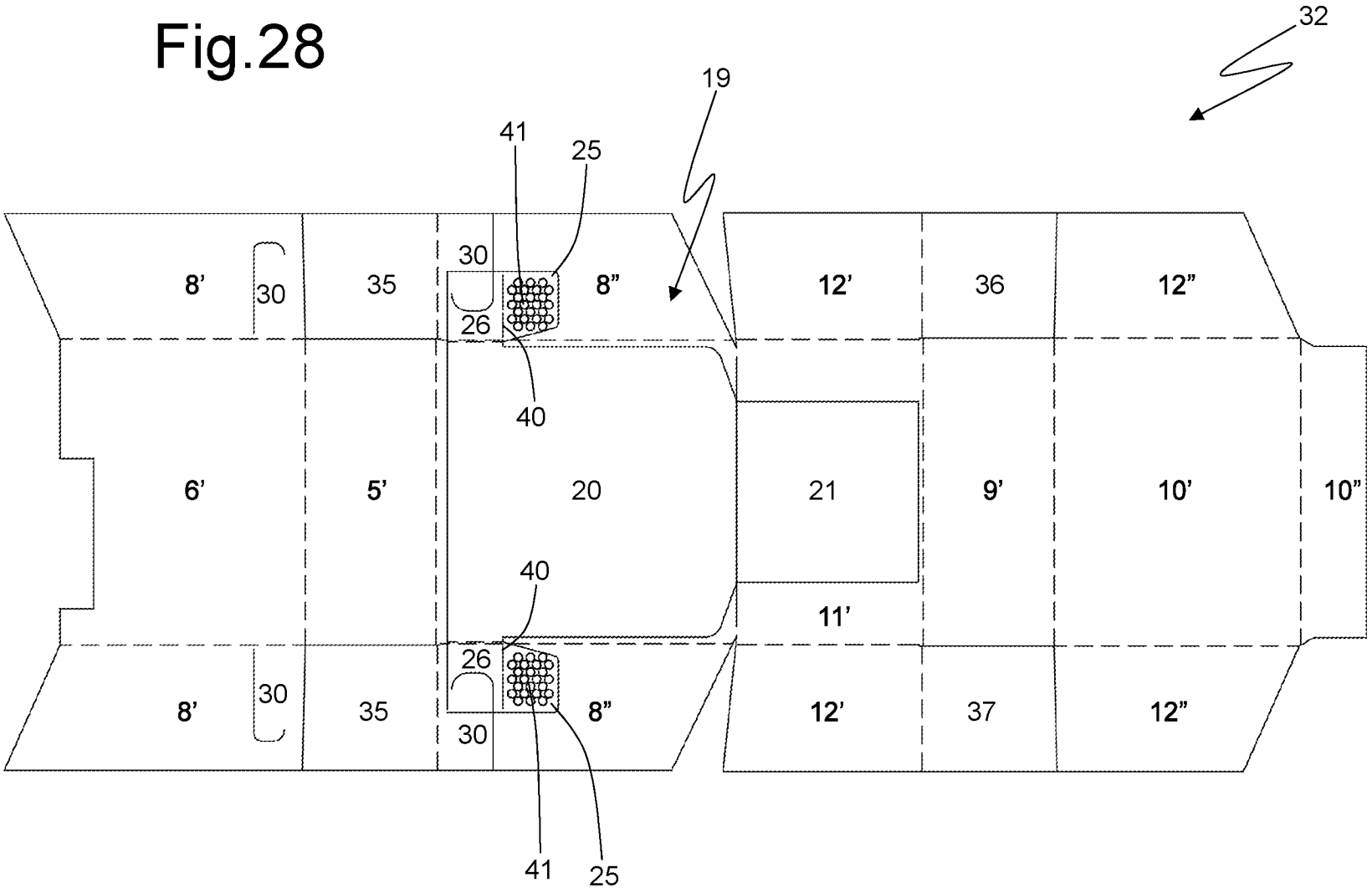
FIG. 28 illustrates the cut-out of FIG. 25 engaged to the partially folded slider of FIG. 27.

In this embodiment there are two buttons 30, which are arranged at the side walls 8 of the container 2; consequently, as shown in FIG. 28, each button 30 consists of a portion of a panel 8" delimited by a corresponding cut 29 and a portion of a panel 8" delimited by a corresponding cut 29.

In the embodiments illustrated in the attached figures, the longitudinal and transverse edges are straight; alternatively, the longitudinal and/or transverse edges could be rounded or chamfered.

In the embodiments illustrated in the attached figures, the cigarette pack 1 contains a group of cigarettes; alternatively, the cigarette pack 1 may contain any other types of smoking articles such as cigars, electric or electronic cigarettes (i.e. cigarettes that generate an aerosol without combustion), cartridges and refills for electronic cigarettes, new generation cigarettes.

The embodiments described herein may be combined with each other without departing from the scope of protection of the present invention.

The cigarette pack 1 described above has numerous advantages.

Firstly, the cigarette pack 1 described above can be classified as "child-proof", i.e. it can prevent opening by children. In fact, to open the cigarette pack 1 described above, it is not sufficient to pull up the lid 4 (before rotating said lid 4) but it is necessary to press the button 30 (buttons 30) or the side walls 8 of the container 2 at the same time; namely, to open the cigarette pack 1 described above it is necessary to make a particular sequence of movements not intuitive for a child.

In addition, the cigarette pack 1 described above, while classifiable as "childproof", is still relatively simple and obvious to open for an adult.

The cigarette pack 1 described above requires an overall quantity of wrapping material that is not excessive, as compared to a similar rigid cigarette pack with a standard hinged lid it has a slightly wider collar 14 and the presence of the slider 19 which is relatively small; consequently, compared to a similar rigid cigarette pack with a standard hinged lid, the cigarette pack 1 described above has an increase in overall weight of wrapping material of between 10 and 20%.

Lastly, the cigarette pack 1 described above can be produced in a packaging machine that is not too different from a standard packaging machine for rigid cigarette packs with hinged lid; consequently, the preparation of a packaging machine for the production of the cigarette pack 1 described above is not particularly expensive.

The invention claimed is:

1. A pack (1) for smoking articles comprising:

a container (2), which is cup-shaped and has: an open top end (3), a bottom wall (5) opposite the open top end (3), a front wall (6) and a rear wall (7), which are parallel to and opposite one another, and two side walls (8), which are parallel to and opposite one another;

an inner wrap (13), which encloses a group of smoking articles and is housed in the container (2);

a hinged lid (4), which is cup-shaped, is movable between a closed position and an open position, and has: an open bottom end, a top wall (9), a front wall (10) and a rear wall (11), which are parallel to and opposite one another, and two side walls (12), which are parallel to and opposite one another;

a collar (14), which embraces the inner wrap (13) and is glued on the inside of the container (2) so as to partially project out of the open top end (3) and engage a corresponding inner surface of the lid (4), when the lid (4) is arranged in a closed position; and a slider (19), which is firmly connected to the lid (4) and is coupled to the container (2) in a sliding manner so as to slide relative to the container (2) along a sliding direction (D1);

wherein there is a locking system (24), which is interposed between the container (2) and the slider (19) and, in the closed position of the lid (4), prevents the slider (19) from sliding relative to the container (2);

wherein the hindering of the sliding of the slider (19) relative to the container (2), which is determined by the locking system (24), can be deactivated by means of an elastic deformation of at least one of said walls (7, 8) of the container (2) by deforming at least one of said walls (7) of the container (2) inwards or outwards;

wherein the locking system (24) comprises: a first stop tab (25), which is integral to a wall (7; 8) of the container (2), is arranged in an intermediate position of the wall (7; 8) of the container (2), projects from the wall (7; 8) of the container (2) towards the inside of the container (2), and has a first edge (28); and a second stop tab (26), which is integral to the slider (19) and has a second edge (27), which, in the closed position, faces and is aligned with the first edge (28) of the first stop tab (25) in the absence of elastic deformations caused from the outside; and wherein the first stop tab (25) is connected to the second stop tab (26) along a tearable line (40) and is designed to be separated, through tearing, from the second stop tab (26) upon first opening of the pack (1) of cigarettes.

2. The pack (1) for smoking articles according to claim 1, wherein the hindering of the sliding of the slider (19) relative to the container (2) determined by the locking system (24), can be deactivated by pressing the container (2) inwards on at least one of said walls (7, 8) of the container (2) to obtain an elastic deformation of at least one of said walls (7, 8) of the container (2) by deforming at least one of said walls (7, 8) of the container (2) inwards or outwards.

3. The pack (1) for smoking articles according to claim 1, wherein the hindering of the sliding of the slider (19) relative to the container (2) determined by the locking system (24), can be deactivated by pressing at least one of said walls (7, 8) of the container (2) inwards to obtain an elastic deformation of at least one of said walls (7, 8) of the container (2) by deforming at least one of said walls (7, 8) of the container (2) inwards or outwards.

4. The pack (1) for smoking articles according to claim 1, wherein the first stop tab (25) is integral to a wall (7; 8) of the container (2) which is deformed inwards or outwards to deactivate the locking system (24).

5. The pack (1) for smoking articles according to claim 4, wherein the first stop tab (25) is glued to the wall (7; 8) of the container (2) by means of a first permanent glue (41).

6. The pack (1) for smoking articles according to claim 4 and comprising a button (30), which is obtained in the wall (7; 8) of the container (2) to which the first stop tab (25) is integral, is defined and delimited by a through cut (29), and is arranged in the area of the second stop tab (26).

7. The pack (1) for smoking articles according to claim 1, wherein the first stop tab (25) is integral to the rear wall (7) of the container (2), is arranged in an intermediate position in the rear wall (7) of the container (2), and projects from the rear wall (7) of the container (2) towards the inside of the container (2).

8. The pack (1) for smoking articles according to claim 7, wherein:

the slider comprises a first rear wall (20), which only rests against the rear wall (7) of the container (2) so as to slide relative to the rear wall (7) of the container (2), and a second rear wall (21), which is connected to the first rear wall (20) by means of a hinge (22) and is glued to the rear wall (11) of the lid (4); and the second stop tab (26) is connected to the first rear wall (20) of the slider (19) along a folding line (38), is folded by 180° against the first rear wall (20) of the slider (19), and is glued to the first rear wall (20) of the slider (19) by means of a second permanent glue (39).

9. The pack (1) for smoking articles according to claim 1, wherein the first stop tab (25) is integral to the side wall (8) of the container (2), is arranged in an intermediate position in the side wall (8) of the container (2), and projects from the side wall (8) of the container (2) towards the inside of the container (2).

10. The pack (1) for smoking articles according to claim 9, wherein:

the slider comprises a first rear wall (20), which only rests against the rear wall (7) of the container (2) so as to slide relative to the rear wall (7) of the container (2), and a second rear wall (21), which is connected to the first rear wall (20) by means of a hinge (22) and is glued to the rear wall (11) of the lid (4); and the second stop tab (26) is connected to the first rear wall (20) of the slider (19) along a folding line (38), and is folded by 90° against the first rear wall (20) of the slider (19).

11. The pack (1) for smoking articles according to claim 1, wherein the container (2) is designed to be elastically deformed in order to deactivate the hindering of the sliding of the slider (19) relative to the container (2), which is determined by the locking system (24), by pressing on a wall (7; 8) of the container (2) near the second stop tab (26) so as to push the second stop tab (26) inwards, deforming the wall (7; 8) of the container (2) integral with the first stop tab (25), inwards.

12. The pack (1) for smoking articles according to claim 1, wherein the container (2) is designed to be elastically deformed in order to deactivate the hindering of the sliding of the slider (19) relative to the container (2), which is determined by the locking system (24), by compressing the two side walls (8) of the container (2) towards one another, and thus deforming the rear wall (7) of the container (2) which is integral with the first stop tab (25), outwards.

13. The pack (1) for smoking articles according to claim 1, wherein the fibers of the material making up the slider (19) are oriented according to a direction (D2), which is perpendicular to the sliding direction (D1).

14. The pack (1) for smoking articles according to claim 1, wherein:

the slider comprises a first rear wall (20), which only rests against the rear wall (7) of the container (2) so as to slide relative to the rear wall (7) of the container (2), and a second rear wall (21), which is connected to the first rear wall (20) by means of a hinge (22) and is glued to the rear wall (11) of the lid (4);

the collar (14) comprises a front wall (15) and two side walls (16);

each side wall (16) of the collar (14) comprises a rear flap (18), which is perpendicular to the side wall (16) and is arranged on the first rear wall (20) of the slider (19); and the first rear wall (20) of the slider (19) has a pair of tabs (23), which are perpendicular to the first rear wall (20) and rest against the side walls (16) of the collar (14).

* * * * *